US010767252B2

(12) United States Patent
Andoh et al.

(10) Patent No.: US 10,767,252 B2
(45) Date of Patent: Sep. 8, 2020

(54) CARBURIZED COMPONENT AND METHOD FOR MANUFACTURING SAME

(71) Applicant: DAIDO STEEL CO., LTD., Nagoya-shi, Aichi (JP)

(72) Inventors: Tomohiro Andoh, Aichi (JP); Naoki Umemori, Aichi (JP); Toshiyuki Morita, Aichi (JP); Yasushi Matsumura, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 930 days.

(21) Appl. No.: 14/895,098

(22) PCT Filed: Jun. 3, 2014

(86) PCT No.: PCT/JP2014/064740
§ 371 (c)(1),
(2) Date: Dec. 1, 2015

(87) PCT Pub. No.: WO2014/196529
PCT Pub. Date: Dec. 11, 2014

(65) Prior Publication Data

US 2016/0122858 A1 May 5, 2016

(30) Foreign Application Priority Data

Jun. 5, 2013 (JP) ..... 2013-119234

(51) Int. Cl.
*C23C 8/34* (2006.01)
*C22C 38/02* (2006.01)
(Continued)

(52) U.S. Cl.
CPC ..... *C23C 8/34* (2013.01); *C21D 1/06* (2013.01); *C21D 1/773* (2013.01); *C21D 6/002* (2013.01);
(Continued)

(58) Field of Classification Search
CPC ..... C22C 38/02
(Continued)

(56) References Cited

U.S. PATENT DOCUMENTS

2013/0146180 A1 6/2013 Kubota
2013/0146181 A1 6/2013 Kubota
(Continued)

FOREIGN PATENT DOCUMENTS

CN 103119188 5/2013
CN 103119189 A 5/2013
(Continued)

OTHER PUBLICATIONS

English language machine translation of JP 2007284739 to Usui et al. Generated Dec. 4, 2018. (Year: 2018).*
(Continued)

*Primary Examiner* — Brian D Walck
(74) *Attorney, Agent, or Firm* — Greenblum & Bernstein, P.L.C.

(57) ABSTRACT

The present invention provides a carburized part which is formed by processing a steel into a shape of a part and performing a carburizing treatment on the steel, the steel having a composition consisting essentially of, in terms of % by mass: 0.10% to 0.40% of C; 0.05% to 2.00% of Si; 0.30% to 2.00% of Mn; 0.30% to 3.00% of Cr; 0.025% or less of N; and as a pinning particle forming element which forms a pinning particle by nitrification, one or two or more elements selected from: 0.020% to 0.100% of Al; 0.01% to 0.20% of Nb; and 0.005% to 0.20% of Ti, and optionally: 0.80% or less of Mo, with the remainder being Fe and inevitable impurities, in which a crystal grain size number of a surface layer of the part at a depth of 50 μm or less from a surface
(Continued)

is greater than 5, and the crystal grain size number of an inner portion of the part at a depth of 3 mm or more from the surface is 5 or less.

2 Claims, 18 Drawing Sheets

(51) Int. Cl.

| | |
|---|---|
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/00*** | (2006.01) |
| ***C23C 8/22*** | (2006.01) |
| ***C21D 1/06*** | (2006.01) |
| ***C21D 1/773*** | (2006.01) |
| ***C21D 6/00*** | (2006.01) |

(52) U.S. Cl.
CPC ..... *C21D 6/005* (2013.01); *C21D 6/008* (2013.01); *C22C 38/00* (2013.01); *C22C 38/001* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C23C 8/22* (2013.01)

(58) Field of Classification Search
USPC ..... 148/319
See application file for complete search history.

(56) References Cited

U.S. PATENT DOCUMENTS

| | | | |
|---|---|---|---|
| 2014/0014234 | A1 | 1/2014 | Okamoto et al. |
| 2014/0363115 | A1 | 12/2014 | Yamada et al. |
| 2017/0283957 | A1 | 10/2017 | Kubota |

FOREIGN PATENT DOCUMENTS

| | | | |
|---|---|---|---|
| DE | 103 22 255 | | 12/2004 |
| JP | 60-262942 | | 12/1985 |
| JP | 64-39354 | | 2/1989 |
| JP | H02-149643 | A | 8/1990 |
| JP | 8-199303 | | 8/1996 |
| JP | H08-311606 | A | 11/1996 |
| JP | 2001-303174 | | 10/2001 |
| JP | 2007284739 | A | 1/2007 |
| JP | 2011-6734 | | 1/2011 |
| JP | 2012-207244 | | 10/2012 |
| JP | 2013-11010 | | 1/2013 |

OTHER PUBLICATIONS

Fuller, Allen J. "Introduction to Carburizing and Carbonitriding." ASM Handbook, vol. 4A, Steel Heat Treating Fundamentals and Processes. 2013 (Year: 2013).*

International Search Report issued in PCT/JP2014/064740, dated Aug. 5, 2014, along with an English translation thereof.

Chinese Office Action issued with respect to Application No. 2014800325529, dated Dec. 22, 2016.

India Office Action, India Patent Office, Application No. 10981/DELNP/2015, dated Jun. 30, 2020.

* cited by examiner

TREATMENT CONDITIONS
FURNACE VOLUME: 400L
PRESSURE: 1500Pa
TEMPERATURE: 1273 to 1323K

| | TREATMENT SYMBOL | TEMPERATURE (K) | CARBURIZATION PERIOD | | DIFFUSION PERIOD | NITRIDING GAS |
|---|---|---|---|---|---|---|
| | | | TIME (ks) | AMOUNT OF $C_3H_8$ (L/min) | TIME (ks) | AMOUNT OF $NH_3$ (L/min) |
| CARBURIZA-TION | A | 1323 | 0. 33 | 1. 00 | 1. 32 | 0. 00 |
| CARBURIZA-TION (+NITRIDING GAS) | D | 1323 | 0. 33 | 1. 00 | 1. 32 | 0. 67 |
| | F | 1273 | 0. 72 | 1. 00 | 2. 40 | 0. 15 |

CHANGES IN AMOUNT OF NITRIDE PARTICLES IN SURFACE LAYER AND INNER PORTION AT 1050°C (1323 K) (No. 7)

*Fig. 20(A)*

$$[AlN]_P = [Al]_P + [N]_P^{Al} = \left\{1+\frac{M^N}{M^{Al}}\right\} \times [Al]_P = \left\{1+\frac{M^N}{M^{Al}}\right\} \times ([Al]_T - [Al]_S) = \left\{1-\frac{M^N}{M^{Al}}\right\} \times \left\{[Al]_T - \frac{2 \times K^{AlN}}{-X+\sqrt{X^2-4Y}}\right\}$$

$$= \left\{1+\frac{M^N}{M^{Al}}\right\} \times \left( [Al]_T - \frac{2 \times K^{AlN}}{-\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\} + \sqrt{\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\}^2 + 4 \times \left\{\frac{M^N}{M^{Al}} \times K^{AlN} + \frac{M^N}{M^{Nb}} \times K^{NbN} + \frac{M^N}{M^{Ti}} \times K^{TiN}\right\}}} \right)$$

. . .

*Fig. 20(B)*

$$[NbN] = \left\{1+\frac{M^N}{M^{Nb}}\right\} \times \left( [Nb]_T - \frac{2 \times K^{NbN}}{-\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\} + \sqrt{\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\}^2 + 4 \times \left\{\frac{M^N}{M^{Al}} \times K^{AlN} + \frac{M^N}{M^{Nb}} \times K^{NbN} + \frac{M^N}{M^{Ti}} \times K^{TiN}\right\}}} \right)$$

. . .

*Fig. 20(C)*

$$[TiN] = \left\{1+\frac{M^N}{M^{Ti}}\right\} \times \left( [Ti]_T - \frac{2 \times K^{TiN}}{-\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\} + \sqrt{\left\{\frac{M^N}{M^{Al}} \times [Al]_T + \frac{M^N}{M^{Nb}} \times [Nb]_T + \frac{M^N}{M^{Ti}} \times [Ti]_T - [N]_T\right\}^2 + 4 \times \left\{\frac{M^N}{M^{Al}} \times K^{AlN} + \frac{M^N}{M^{Nb}} \times K^{NbN} + \frac{M^N}{M^{Ti}} \times K^{TiN}\right\}}} \right)$$

. . .

CARBURIZED COMPONENT AND METHOD FOR MANUFACTURING SAME

TECHNICAL FIELD

The present invention relates to a carburized part, and a method for manufacturing the same, and particularly relates to a carburized part having satisfactory fatigue properties against any of a low load input and a high load input, and a method for manufacturing the same.

BACKGROUND ART

Conventionally, it has been considered that, in order to improve mechanical properties, it is desirable to retain crystal grains to be fine in gears, bearing parts, shafts and other mechanical parts, and have been performed in that manner.

For example, in mechanical parts such as gears and bearing parts, which require high surface strength, JIS steel types such as SCr420 are generally used after having been processed into the shapes of parts and then subjected to a surface-hardening treatment by carburization hardening. However, in this case, studies for refining crystal grains as much as possible have been conducted conventionally.

Specifically, when the above-described parts are subjected to a carburizing treatment, particularly, when the parts are subjected to a carburizing treatment at a high temperature, coarsening of the crystal grains in the surface layer is easily caused.

Conventionally, various studies and proposals to prevent crystal grains from becoming coarse in a surface layer have been made.

A technique of pinning grain boundaries by precipitating nitride particles such as AlN and Nb (C,N) in a dispersed state as pinning particles at a manufacturing step before a carburizing treatment has been widely known as a technique for preventing crystal grains from becoming coarse, and techniques of this kind are disclosed in, for example, Patent Document 1 and Patent Document 2 below.

In the technique of precipitating nitride particles of AlN or the like in a dispersed state as pinning particles at a manufacturing step before a carburizing treatment, in order to sufficiently precipitate the nitride particles of AlN or the like (pinning particles), large amounts of N and Al or Nb are added in steel in advance.

In this case, coarsening of the crystal grains is prevented in the surface layer at the time of the carburizing treatment, and crystal grains in the inner portion of the part are also retained to be fine due to the pinning effect by nitride particles of AlN or the like to be precipitated in the steel.

It has been conventionally considered that a part in which the crystal grains in the surface layer are prevented from becoming coarse and the crystal grains in the inner portion of the part are refined in this manner, that is, a part having fine crystal grains in both of the surface layer and the inner portion of the part, has satisfactory mechanical properties, particularly, satisfactory fatigue properties.

In addition, in Patent Document 3 below, in order to prevent denitrification and coarsening of crystal grains caused by the denitrification during a carburizing treatment, or in order to ensure fine crystal grain stability by supplying nitrogen to a surface layer to form nitride particles on the surface layer, a technique of introducing a nitriding gas such as $NH_3$ into a treatment furnace during a vacuum carburizing treatment (including a temperature rising period by heating) is disclosed.

However, in the technique disclosed in Patent Document 3, the nitriding gas introduction is merely described and a relationship in quantity of nitride particles and a relationship in crystal grain size of nitride particles between the surface layer of the part and the inner portion of the part, and the like are not described.

BACKGROUND ART DOCUMENT

Patent Document

Patent Document 1: JP-A-2001-303174

Patent Document 2: JP-A-08-199303

Patent Document 3: German Patent Application Publication No. 10322255

SUMMARY OF THE INVENTION

Problems that the Invention is to Solve

However, from the studies of the inventors, it has been confirmed that the thought that when crystal grains are fine, fatigue properties are satisfactory is not actually correct, and in terms of fatigue properties, a suitable crystal grain size is different depending on the type of input, specifically, with respect to a low load input (in a case of a low load input, the number of repeated inputs until steel reaches fracture is large. That is, an input adding cycle is a high cycle), fine crystal grains are preferable, and in contrast, with respect to a high load input (in a case of a high load input, the number of repeated inputs until steel reaches fracture is small. That is, an input adding cycle is a low cycle), when crystal grains are coarse, fatigue properties are rather satisfactory.

That is, in the technique of precipitating a large number of nitride particles at a manufacturing step before a carburizing treatment, since the crystal grains in both of the surface layer and the inner portion of the part are fine, the fatigue properties against a high load input are not sufficient. In addition, when crystal grains are retained to be fine, the hardenability of the inner portion of the part is deteriorated.

Additionally, in the technique of preventing coarsening of crystal grains by precipitating a large number of nitride particles such as AlN at a manufacturing step before a carburizing treatment, the inner hardness of the part is also increased by the precipitation of nitride particles and thus workability is deteriorated.

Further, in this technique, for example, even when a sufficient amount of AlN or the like is precipitated in the steel at a manufacturing step before a carburizing treatment, in a high-temperature carburizing treatment under vacuum, there is a problem of denitrification occurring in the surface layer during the treatment. Accordingly, when denitrification occurs, a solid solution of the nitride particles proceeds and the nitride particles are decreased. Thus, there is another problem of coarsening of crystal grains occurring from the portion in which the nitride particles are decreased.

In order to prevent denitrification and coarsening of crystal grains caused by the denitrification during the carburizing treatment, or in order to ensure fine crystal grain stability by supplying nitrogen to the surface layer to form nitride particles on the surface layer, a technique of introducing a nitriding gas such as $NH_3$ into a treatment furnace during a vacuum carburizing treatment (including a temperature rising period by heating) is also known.

As described above, in the circumstance in which a carburized part having satisfactory fatigue properties against any of a low load input and a high load input has not been provided, an object of the present invention is to provide a carburized part having satisfactory fatigue properties against any of a low load input and a high load input, and a method for manufacturing the same.

Means for Solving the Problems

The present invention relates to the following [1] and [2].

[1] A carburized part which is formed by processing a steel into a shape of a part and performing a carburizing treatment on the steel, the steel having a composition including consisting essentially of, in terms of % by mass:

0.10% to 0.40% of C;
0.05% to 2.00% of Si;
0.30% to 2.00% of Mn;
0.30% to 3.00% of Cr;
0.025% or less of N; and as a pinning particle forming element which forms a pinning particle by nitrification, one or two or more elements selected from:

0.020% to 0.100% of Al;
0.01% to 0.20% of Nb; and
0.005% to 0.20% of Ti, and optionally:

0.80% or less of Mo, with the remainder being Fe and inevitable impurities, in which a crystal grain size number of a surface layer of the part at a depth of 50 μm or less from a surface is greater than 5, and the crystal grain size number of an inner portion of the part at a depth of 3 mm or more from the surface is 5 or less. [2] A method for manufacturing a carburized part, the method including:

processing a steel into a shape of a part, the steel having a composition including consisting essentially of, in terms of % by mass:

0.10% to 0.40% of C;
0.05% to 2.00% of Si;
0.30% to 2.00% of Mn;
0.30% to 3.00% of Cr;
0.025% or less of N; and as a pinning particle forming element which forms a pinning particle by nitrification, one or two or more elements selected from:

0.020% to 0.100% of Al;
0.01% to 0.20% of Nb; and
0.005% to 0.20% of Ti, and optionally:

0.80% or less of Mo, with the remainder being Fe and inevitable impurities;

then heating the steel in a treatment furnace at a temperature of $A_3$ point or higher and holding the steel to perform a vacuum carburizing treatment on the steel with a carburizing gas under reduced pressure;

controlling a nitriding atmosphere by introducing a nitriding gas into the treatment furnace during the vacuum carburizing treatment, such that a total amount V of nitride particles containing one or two or more of AlN which is a nitride of Al, NbN which is a nitride of Nb, and TiN which is a nitride of Ti in a surface layer at a depth of 50 μm or less from a surface of the part is maintained at a value represented by the following Equation (1) or more during the carburizing treatment; and determining the content of N in the steel such that the total amount V of the nitride particles in an inner portion of the part at a depth of 3 mm or more from the surface is less than the value represented by the following Equation (1) during the carburizing treatment, thereby obtaining a carburized part in which a crystal grain size number of the surface layer of the part is greater than 5 and the crystal grain size number of the inner portion of the part is 5 or less, $$(3.33\times10^{-5}\times C+7.33\times10^{-5})\times T-(3.58\times10^{-2}\times C+7.37\times10^{-2}) \quad \text{Equation (1)}$$

in the Equation (1), C represents a C concentration, and T represents a temperature, provided that the unit of V is % by mass, the unit of C is % by mass, and the unit of T is K.

Advantage of the Invention

According to the present invention, it is possible to provide a carburized part having satisfactory fatigue properties against any of a low load input and a high load input, and a method for manufacturing the same.

BRIEF DESCRIPTION OF THE DRAWINGS

FIGS. 20(A)-20(C) are equations representing the precipitated amount of each of AlN, NbN and TiN.

MODE FOR CARRYING OUT THE INVENTION

Figure 1:
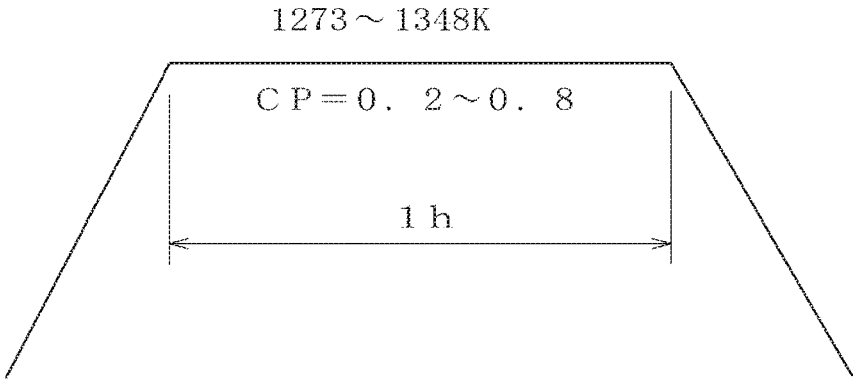
FIG. 1 is a diagram showing carburizing treatment conditions for investigating the presence or absence of crystal grain coarsening.

Embodiments of the present invention will be described below.

A carburized part of the present invention is a part in which the crystal grains in the surface layer of the part at a depth of 50 μm or less from the surface are refined to be finer than the crystal grains in the inner portion of the part at a depth of 3 mm or more from the surface, and the crystal grain size number of the surface layer of the part is set to greater than 5 or more and the crystal grain size number of the inner portion of the part is set to 5 or less.

For an input to a mechanical part which is subjected to a carburizing treatment and used, for example, a gear that is a mechanical structure part for automobiles, there may be a low load input and a high load input.

Specifically, an input that is accompanied by a contact between gears at the time of normal travelling of an automobile corresponds to the former.

In addition, there is an input suddenly applied to a gear when an automobile runs over a curbstone of a road or other protrusions. The input of this type corresponds to the high load input of the latter.

When studying a relationship between crystal grain size and fatigue properties of a carburized part, the inventors obtained the following findings. Regarding the relationship therebetween, the fatigue properties are not uniformly improved as the crystal grain size becomes finer, and the relationship between the crystal grain size and the fatigue properties is different depending on the type of input. Specifically, under a low load input, as the crystal grain size of the surface layer of the part is increased, the fatigue properties become better. In contrast, under a high load input, as the crystal grain size of the inner portion of the part is decreased, that is, as the crystal grains therein become coarser, the fatigue properties become better. Further, with a crystal grain size number of 5 as a boundary, when the crystal grain size number of the surface layer is greater than 5, high fatigue properties against a low load input are attained. When the crystal grain size number of the inner portion of the part is 5 or less, satisfactory fatigue properties against a high load input are attained.

The carburized part of the present invention has been invented under such findings.

As described above, conventionally, it has been uniformly considered that fine crystal grains are desirable in terms of fatigue properties. In order to attain satisfactory fatigue properties against any of different types of inputs, it has not been considered that the crystal grain size of the surface layer of the part is made to be fine and the crystal grain size of the inner portion of the part is made to be coarser than the crystal grain size of the surface layer, and naturally, a carburized part obtained by realizing this consideration has not been provided.

Herein, the present invention provides a carburized part in which the crystal grain size of the surface layer of the part is a fine crystal grain size having a crystal grain size number of greater than 5, while the crystal grain size of the inner portion of the part is a coarse crystal grain size having a crystal grain size number of 5 or less based on the above-described findings, and the carburized part of the present invention can exhibit satisfactory fatigue properties against both of a low load input and a high load input.

The above-mentioned [3] relates to a method for manufacturing the carburized part according to the above-mentioned [1] or [2]. In this manufacturing method, a large amount of nitrides of Al, Nb, and Ti are precipitated in the surface layer by introducing a nitriding gas into a carburizing treatment furnace, and permeating and dispersing N into the surface layer of the part, whereby the crystal grains of the surface layer is prevented from growing by the pinning effect to retain the crystal grains in the surface layer to be fine.

The Equation (1) in [3] represents the minimum total amount of nitride particles (pinning particles) required to prevent crystal grain coarsening.

The crystal grains are prevented from growing by the nitride particles, that is, pinning particles.

The grain growth of the crystal grains easily occurs when the temperature of steel increases. Accordingly, it is necessary that the total amount of nitride particles as pinning particles is increased as the temperature increases.

That is, the total amount of nitride particles required to prevent crystal grains from growing is a function of temperature.

In addition, the inventors have found that in a process of a vacuum carburizing treatment when a carburized part is manufactured, the temperature at which crystal grains grow, that is, a crystal grain coarsening temperature and a C concentration in steel are closely connected and as the C concentration increases, the crystal grain coarsening temperature decreases, that is, the crystal grains easily grow.

Accordingly, it is necessary to increase the total amount of nitride particles required to prevent crystal grains from growing as the C concentration in the steel increases.

That is, it has been found that the total amount of nitride particles required to prevent crystal grains from growing is a function of the temperature T and the C concentration.

As will be more clearly described later, it has been found that the minimum amount of nitride particles required to prevent crystal grain growth are represented by the above-described Equation (1) as a result of various tests and studies.

Accordingly, when nitride particles in an amount more than the amount represented by the Equation (1) are precipitated in the steel (in the surface layer at a depth of 0.05 mm from the surface of the steel), crystal grains can be prevented from growing. That is, crystal grains can be retained to be fine in the surface layer of the part. More specifically, the crystal grain size of the surface layer can be retained at a fine crystal grain size having a crystal grain size number of greater than 5.

In the manufacturing method of the present invention, the sentence "a nitriding gas is introduced into the furnace during the carburizing treatment such that the total amount V of precipitated nitride particles containing one or two or more of AlN which is a nitride of Al, NbN which is a nitride of Nb, and TiN which is a nitride of Ti in the surface layer of the steel is maintained at a value represented by the Equation (1) or more" means the above-mentioned matter.

Here, V represents the total amount of nitride particles actually precipitated in the steel, and the value of V can be obtained based on the amount of N and the amounts of Al, Nb, and Ti (provided that, inclusions and crystallized products thereof are excluded therefrom) included in the steel at the time of the carburizing treatment, and solubility products of each pair of Al and N, Nb and N, and Ti and N.

In the present invention, the following equation is used as an equation which represents the solubility product of Al and N.

$$\log([Al]_S \times [N]_S) = 1.03 - 6770/T \quad \text{Equation (2)}$$

The Equation (2) is an equation which is known as an equation of W. C. Leslie (W. C. Leslie, R. L. Rickett, C. L. Dotson and W. C. Walton: Trans. ASM, 46 (1954), 1470.). As the equation which represents the solubility product of Al and N, this equation of W. C. Leslie is being widely used.

In addition, the following equation is used as an equation which represents the solubility product of Nb and N (NARITA Kiichi, and KOYAMA Shinji: The Iron and Steel, 52 (1966), 788).

$$\log([Nb]_S \times [N]_S) = 2.89 - 8500/T \quad \text{Equation (3)}$$

Further, the following equation is used as an equation which represents the solubility product of Ti and N (ARIKAWA Masayasu, and NARITA Kiichi: The Iron and Steel, 38 (1952), 739).

$$\log([Ti]_S \times [N]_S) = 5.03 - 17800/T \quad \text{Equation (4)}$$

Hereinafter, a method for obtaining a value of V using these equations of the solubility products will be described in detail.

When defining as shown below:

$[Al]_T$, $[Nb]_T$, $[Ti]_T$, and $[N]_T$: total amount of each element (excluding inclusions and crystallized products), $[Al]_S$, $[Nb]_S$, $[Ti]_S$, and $[N]_S$: amount of each solid-soluted element, $[Al]_P$, $[Nb]_P$, and $[Ti]_P$: amount of each element precipitated, $$[N]_P^{Al}, [N]_P^{Nb}, [N]_P^{Ti}: \quad \text{[Math. 1]}$$

amount of N precipitated in each of nitrides of AlN, NbN, and TiN, [AlN], [NbN], and [TiN]: amount of each nitride precipitated, $M^{Al}$, $M^{Nb}$, $M^{Ti}$, and $M^N$: amount of atoms of each element, $$\log K^{AlN} = \log([Al]_S \times [N]_S),$$

$$\log K^{NbN} = \log([Nb]_S \times [N]_S), \text{ and}$$

$$\log K^{TiN} = \log([Ti]_S \times [N]_S) = b - a/T,$$

from the relationship between the amounts of atoms in each nitride:

[Math. 2]

$$[Al]_P + [N]_P^{Al} = [AlN] \quad (A)$$

$$[Nb]_P + [N]_P^{Nb} = [NbN], \text{ and} \quad (B)$$

$$[Ti]_P + [N]_P^{Ti} = [TiN], \quad (C)$$

from the balance of each element:

$$[Al]_S + [Al]_P = [Al]_T, \quad (D)$$

$$[Nb]_S + [Nb]_P = [Nb]_T, \text{ and} \quad (E)$$

$$[Ti]_S + [Ti]_P = [Ti]_T, \quad (F)$$

[Math. 2]

$$[N]_S + [N]_P^{Al} + [N]_P^{Nb} + [N]_P^{Ti} = [N]_T \quad (G)$$

from the relationship between atomic weight ratios in each precipitate:

[Math. 4]

$$[N]_P^{Al} = \frac{M^N}{M^{Al}} \times [Al]_P \quad (H)$$

$$[N]_P^{Nb} = \frac{M^N}{M^{Nb}} \times [Nb]_P, \text{ and} \quad (I)$$

$$[N]_P^{Ti} = \frac{M^N}{M^{Ti}} \times [Ti]_P, \quad (J)$$

from the relationship between the solubility products:

$$[Al]_S \times [N]_S = K^{AlN}, \quad (K)$$

$$[Nb]_S \times [N]_S = K^{NbN}, \text{ and} \quad (L)$$

$$[Ti]_S \times [N]_S = K^{TiN}, \quad (M)$$

from (D), (H), and (K):

[Math. 5]

$$[N]_P^{Al} = \frac{M^N}{M^{Al}} \times \{[Al]_T - [Al]_S\} = \frac{M^N}{M^{Al}} \times \left\{[Al]_T - \frac{K^{AlN}}{[N]_S}\right\}, \quad (N)$$

from (E), (I), and (L):

[Math. 6]

$$[N]_P^{Nb} = \frac{M^N}{M^{Nb}} \times \{[Nb]_T - [Nb]_S\} = \frac{M^N}{M^{Nb}} \times \left\{[Nb]_T - \frac{K^{NbN}}{[N]_S}\right\}, \quad (O)$$

from (F), (J), and (M):

[Math. 7]

$$[N]_P^{Ti} = \frac{M^N}{M^{Ti}} \times \{[Ti]_T - [Ti]_S\} = \frac{M^N}{M^{Ti}} \times \left\{[Ti]_T - \frac{K^{TiN}}{[N]_S}\right\}, \quad (P)$$

when substituting (N), (O), and (P) into (G):

$$[N]_S + M^N/M^{Al} \times \{[Al]_T - K^{AlN}/[N]_S\} + M^N/M^{Nb} \times \{[Nb]_T - K^{NbN}/[N]_S\} + M^N/M^{Ti} \times \{[Ti]_T - K^{TiN}/[N]_S\} = [N]_T, \text{ and}$$

$$[N]_S^2 + (M^N/M^{Al} \times [Al]_T + M^N/M^{Nb} \times [Nb]_T + M^N/M^{Ti} \times [Ti]_T - [N]_T) \times [N]_S - (M^N/M^{Al} \times K^{AlN} + M^N/M^{Nb} \times K^{NbN} + M^N/M^{Ti} \times K^{TiN}) = 0,$$

herein, when $$X = (M^N/M^{Al} \times [Al]_T + M^N/M^{Nb} \times [Nb]_T + M^N/M^{Ti} \times [Ti]_T - [N]_T), \text{ and}$$

$$Y = -(M^N/M^{Al} \times K^{AlN} + M^N/M^{Nb} \times K^{NbN} + M^N/M^{Ti} \times K^{TiN})$$

are set, $$[N]_S^2 + X \cdot [N]_S + Y = 0,$$

[Math. 8]

$$[N]_S = \frac{-X + \sqrt{X^2 - 4Y}}{2},$$

[Math. 9]

$$[Al]_S = \frac{K^{AlN}}{[N]_S} = \frac{2 \times K^{AlN}}{-X + \sqrt{X^2 - 4Y}} \text{ from } (K), \quad (K)$$

$$[Nb]_S = \frac{K^{NbN}}{[N]_S} = \frac{2 \times K^{NbN}}{-X + \sqrt{X^2 - 4Y}} \text{ from } (L) \text{ and}, \quad (L)$$

$$[Ti]_S = \frac{K^{TiN}}{[N]_S} = \frac{2 \times K^{TiN}}{-X + \sqrt{X^2 - 4Y}} \text{ from } (M), \quad (M)$$

When (A) is substituted with (H) and further substituted with (K)', an Equation (5) shown in FIG. 20(A) can be obtained.

In the same manner, Equations (6) and (7) shown in FIGS. 20(B) and 20(C) can be obtained.

Thus, as shown in the following Equation (8), the total amount V of AlN, NbN, and TiN is obtained as a total amount of nitride particles in the steel (surface layer of the steel).

$$V = [AlN] + [NbN] + [TiN] \quad \text{Equation (8)}$$

In addition, when the added amounts of Al, Nb, and Ti are small and in the case where a result of the amount of solid solution $[Z]_S$>the total amount $[Z]_T$ is obtained while setting Al, Nb, and Ti to Z in the Equations (K)', (L)', and (M)', the amount of solid solution $[Z]_S$=the amount of addition $[Z]_T$ is set and the equations subsequent to the Equations (N), (O), and (P) are recalculated.

As described above, in accordance with the manufacturing method of the above-mentioned [3], during the vacuum carburizing treatment, by precipitating the nitride particles in the surface layer of the part such that the amount of the nitride particles is equal to or more than the value of the Equation (1) determined by the C concentration of the surface layer of the part and the treatment temperature, that is, the value of the Equation (1) representing the minimum amount of the nitride particles required for preventing crystal grain growth, the crystal grains in the surface layer of the part can be prevented from becoming coarse.

In other words, by introducing a nitriding gas into the heat treatment furnace required to precipitate the nitride particles in the above-described amount, it is possible to prevent the crystal grains from becoming coarse in the surface layer of the part.

On the other hand, in the manufacturing method of the above-mentioned [3], a small amount of N is incorporated in the steel in advance such that the total amount V of the nitride particles in the inner portion of the part at a depth of 3 mm or more from the surface is less than the value of the Equation (1) during the carburizing treatment.

In this manner, the crystal grain size of the inner portion of the part can be a coarse crystal grain size having a crystal grain size number of 5 or less.

That is, by the manufacturing method of the above-mentioned [3], it is possible to manufacture a carburized part of the above-mentioned [1] and [2] in which the crystal grain size of the surface layer of the part is a fine crystal grain size having a crystal grain size number of greater than 5 and the crystal grain size of the inner portion of the part is a coarse crystal grain size having a crystal grain size number of 5 or less.

In the manufacturing method of the above-mentioned [3] of the present invention, by forming nitride particles in the surface layer as pinning particles by adding a small amount of N in the steel at the stage of melting the steel and introducing a nitriding gas at the time of the vacuum carburization, while preventing the crystal grains from becoming coarse in the surface layer to retain crystal grains to be fine in the surface layer, the crystal grains in the inner portion of the part are allowed to grow by decreasing the amount of N in the steel to make coarse crystal grains so as to obtain coarse crystal grains having a crystal grain size number of 5 or less in the inner portion of the part.

Therefore, in the manufacturing method of the present invention, since a large amount of nitride particles may not be precipitated in steel in a dispersed state in the step of manufacturing steel before carburization, it is possible to prevent deterioration in the workability of steel.

In addition, a problem of causing crystal grain growth resulting from the occurrence of denitrification from the surface layer during the vacuum carburizing treatment can be also solved.

Further, during the carburizing treatment, an appropriate amount of nitriding gas, such as ammonia, which is required, can be supplied and thus it is possible to prevent denitrification or crystal grain growth caused by an insufficient amount of nitriding gas being introduced. Also, it is also possible to solve a problem that when an excessive amount of nitriding gas is supplied in contrast, the furnace material of the treatment furnace is significantly damaged or corrosion thereof is promoted.

Furthermore, the used amount of expensive ammonia gas can be decreased and thus the cost required for nitriding gas can be reduced.

In addition, in the manufacturing method of the present invention, by understanding a change in the N concentration in the surface layer of the part when the introduced amount of nitriding gas is changed, and the relationship therebetween in advance, it is possible to control the amount of nitriding gas to be appropriate.

In the carburized part and the method for manufacturing a carburized part of the present invention, Mo: 0.80% or less (refer to the above-mentioned [2] and [4]) can be incorporated in the steel.

Next, the reasons for limiting the chemical components of the steel in the present invention will be described below.

C: 0.10% to 0.40%

The amount of C is required to be to 0.10% or more to ensure the strength of the core of the part, but when the amount of C is excessive, the toughness of the core is deteriorated. Thus, the upper limit of the amount of C is set to 0.40%.

Si: 0.05% to 2.00%

The amount of Si is required to be to 0.05% or more to achieve deoxidation, but when the amount of Si is more than 2.00%, cracks or the like occur at the time of forging to significantly deteriorate cold workability and warm workability. Thus, the upper limit of the amount of Si is set to 2.00%.

Mn: 0.30% to 2.00%

The Mn is an element that is required to control the form of inclusions such as MnS and to ensure hardenability, and thus the amount of Mn is required to be 0.30% or more. However, when the amount of Mn is excessive, cold workability, warm workability, and, machine workability particularly, machinability, are deteriorated. Thus, the upper limit of the amount of Mn is set to 2.00%.

Cr: 0.30% to 3.00%

Cr is an element for improving strength or toughness and the amount of Cr contained is 0.30% or more. However, an excessive addition of Cr causes deterioration in workability and an increase in costs. Thus, the upper limit of the amount of Cr is set to 3.00%.

N: 0.025% or Less

N is a useful element for preventing crystal grain growth at the time of a vacuum carburizing treatment by combining with Al, Nb, or Ti to form nitride particles as pinning particles, and 0.025% or less of N is incorporated in the steel in advance. The amount of N contained is desirably 0.005% or more.

Al: 0.020% to 0.100%, Nb: 0.01% to 0.20%, and Ti: 0.005% to 0.20%

Al, Nb, and Ti are effective elements for preventing crystal grains from growing at the time of a carburizing treatment and thus one or two or more of Al: 0.020% to 0.100%, Nb: 0.01% to 0.20%, and Ti: 0.005% to 0.20% are added.

However, when the amount thereof is excessive, workability is deteriorated or coarse nitrides are formed. Thus, the amount of each element within the above ranges is added.

Mo: 0.80% or Less

Mo is an element for improving strength and is added as required. However, when the added amount of Mo is excessive, more than 0.80%, deterioration in workability and an increase in costs are caused. Thus, the upper limit of the amount of Mo is set to 0.80% or less.

The added amount of Mo is preferably 0.01% to 0.30%.

In addition, at the time of melting steel, P: <0.030%, and S: <0.030% are included in the steel as inevitable impurities and particularly in the melting of steel using an electric furnace, Cu and Ni are each included in the steel at levels of Cu: <0.30%, and Ni: <0.25% in some cases. In the present invention, Cu and Ni, which are included in the steel at such levels, are also inevitable impurity components.

[I](Test for Deviation of Equation (1))

As shown in Table 1, test pieces having a shape of (25×100 mm obtained from SCr420 steels having various amounts of Al, Ti, Nb, and N and defined by JIS G 4053 (2008) were used to investigate the presence or absence of crystal grain coarsening by performing gas carburization for 1 hour at various temperatures as shown in FIG. 1 while changing the C concentration of the surface layer from 0.2% C to 0.8% C. Further, the contents of JIS G 4053 (2008) are incorporated herein by reference.

In addition, the used carburizing gas and the other conditions for the carburizing treatment were as follow.

A drip injection type gas carburizing furnace was used, a drip injection liquid $CH_3OH$ was 600 ml/h, an adjustment gases were $C_3H_8$, and $N_2$, and a treatment time was set to 120 min.

In addition, the C concentration was measured in such a manner that cut scrapes at a depth of 0.05 mm from the surface of each test piece were collected and combustion analysis according to JIS G 1211-3 (2011) was performed to determine the amount of C. Further, the contents of JIS G 1211-3 (2011) are incorporated herein by reference.

In addition, the presence or absence of crystal grain coarsening and the crystal grain size number were determined according to a crystal grain size test method of JIS G 0551 (1998). Further, the contents of JIS G 0551 (1998) are incorporated herein by reference.

Here, in the steels shown in Table 1, the N concentration of the surface layer is changed from 0.008% to 0.025% according to a change in the amount of N contained in each steel.

In addition, even when P: ≤0.030%, S: ≤0.030%, Cu: ≤0.30%, and Ni: ≤0.25% are contained in the steels shown in Table 1, these elements are impurities, and therefore not shown in the table.

TABLE 1

| Chemical composition (% by mass, the remainder being Fe) | | | | | | | | | | | | |
|---|---|---|---|---|---|---|---|---|---|---|---|---|
| Symbol | Type of steel | C | Si | Mn | Cr | Mo | Al | s-Al | Ti | Excessive Ti | Nb | N |
| a | SCr420 | 0.20 | 0.21 | 0.74 | 1.15 | 0.03 | 0.050 | 0.049 | — | — | — | 0.008 |
| b | SCr420 | 0.20 | 0.21 | 0.75 | 1.15 | 0.03 | 0.026 | 0.025 | — | — | — | 0.015 |
| c | SCr420 | 0.20 | 0.21 | 0.75 | 1.15 | 0.03 | 0.031 | 0.030 | — | — | — | 0.014 |
| d | SCr420 | 0.20 | 0.21 | 0.75 | 1.15 | 0.03 | 0.035 | 0.034 | — | — | — | 0.014 |
| e | SCr420 | 0.21 | 0.21 | 0.75 | 1.14 | 0.03 | 0.039 | 0.038 | — | — | — | 0.014 |
| f | SCr420 | 0.20 | 0.20 | 0.74 | 1.15 | 0.03 | 0.050 | 0.049 | — | — | — | 0.015 |
| g | SCr420 | 0.20 | 0.21 | 0.75 | 1.16 | 0.03 | 0.018 | 0.017 | — | — | — | 0.025 |
| h | SCr420 | 0.20 | 0.20 | 0.75 | 1.14 | 0.03 | 0.021 | 0.020 | — | — | — | 0.025 |
| i | SCr420 | 0.20 | 0.20 | 0.75 | 1.15 | 0.03 | 0.026 | 0.025 | — | — | — | 0.025 |
| j | SCr420 | 0.20 | 0.20 | 0.74 | 1.14 | 0.03 | 0.033 | 0.032 | — | — | — | 0.024 |
| k | SCr420 | 0.19 | 0.20 | 0.76 | 1.14 | 0.03 | 0.004 | 0.003 | 0.049 | 0.015 | — | 0.010 |
| l | SCr420 | 0.20 | 0.20 | 0.74 | 1.16 | 0.03 | 0.004 | 0.003 | 0.051 | 0.020 | — | 0.009 |
| m | SCr420 | 0.20 | 0.21 | 0.75 | 1.15 | 0.03 | 0.004 | 0.003 | — | — | 0.030 | 0.022 |
| n | SCr420 | 0.21 | 0.20 | 0.75 | 1.14 | 0.03 | 0.004 | 0.003 | — | — | 0.050 | 0.015 |

In addition, O which is precipitated as an inclusion $Al_2O_3$ is not shown and regarding Al, the remaining Al is shown as "s-Al" as an amount effective for forming nitride particles as pinning particles.

Further, in k and 1 which are Ti-added steels, Ti whose amount is equal to or less than the amount of N in terms of a molar ratio is crystallized as TiN and does not contribute to forming pinning particles. Thus, the remaining Ti is shown as excessive Ti in Table 1.

Incidentally, regarding the amount of Ti actually included in the initial steel including an amount of Ti to be crystallized as TiN, k includes Ti: 0.049% and 1 includes Ti: 0.051%. In addition, regarding N, k includes N: 0.010% and 1 includes N: 0.009%.

Figure 2:
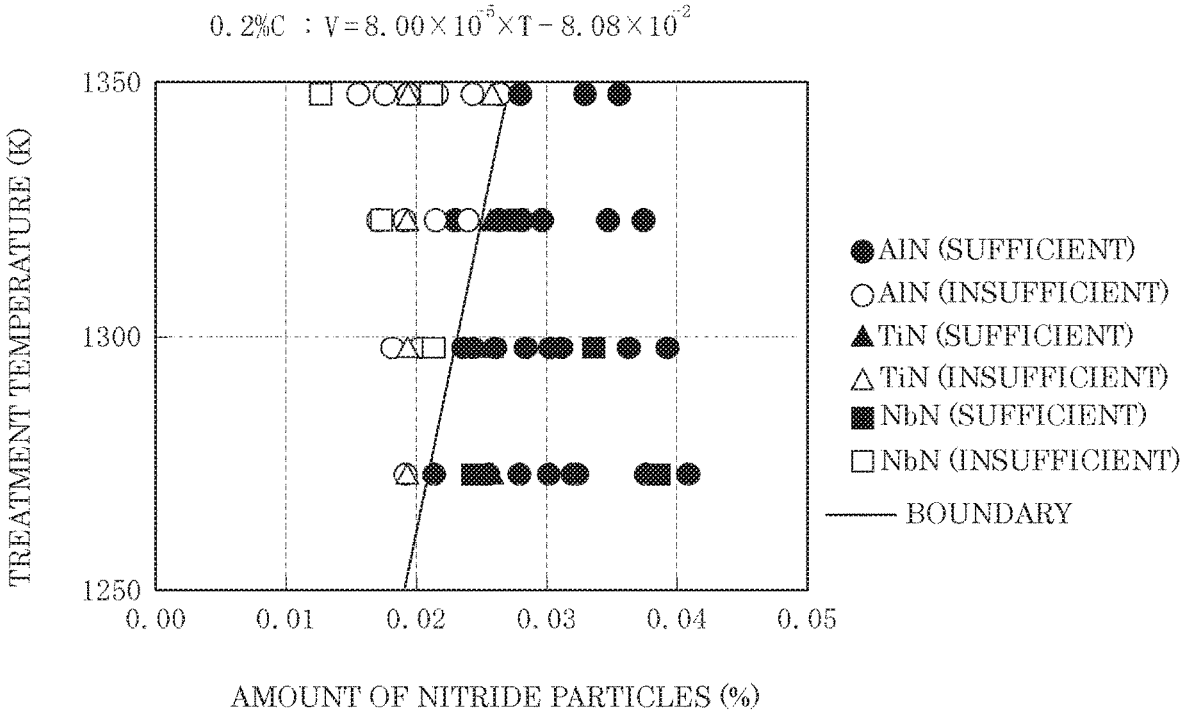
FIG. 2 is a diagram showing a relationship between the amount of nitride particles and a treatment temperature at 0.2% C.
Figure 3:
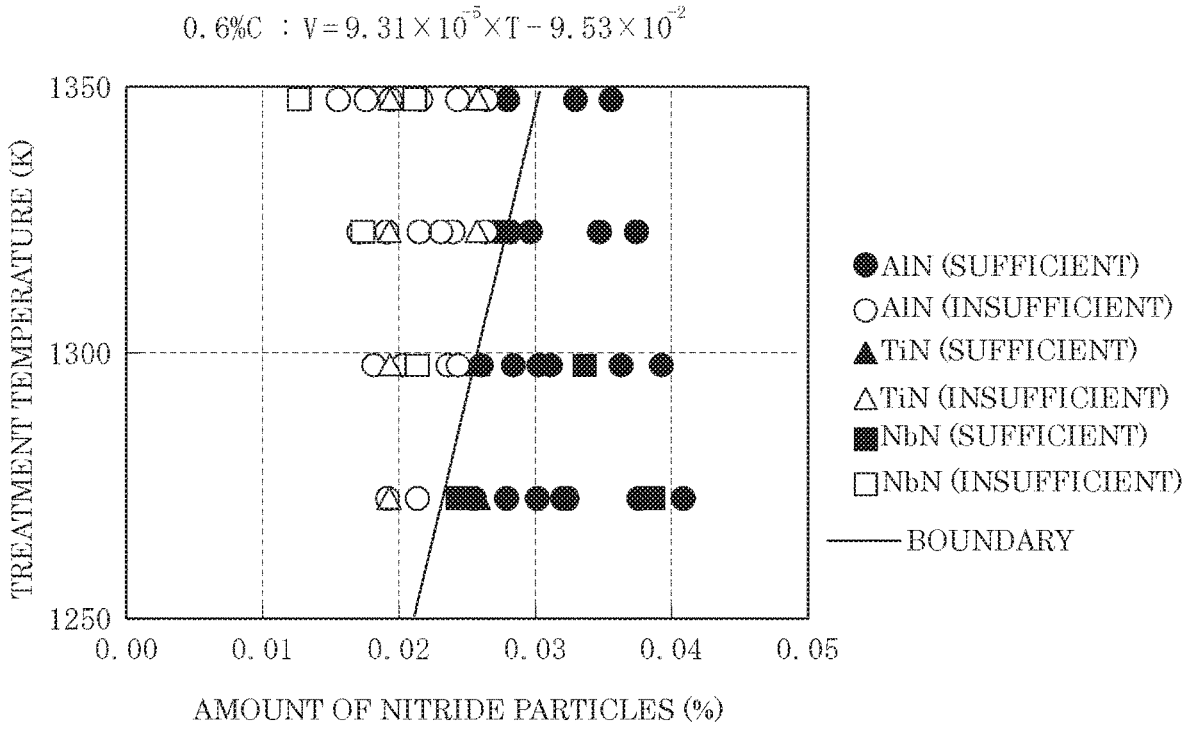
FIG. 3 is a diagram showing a relationship between the amount of nitride particles and a treatment temperature at 0.6% C.
Figure 4:
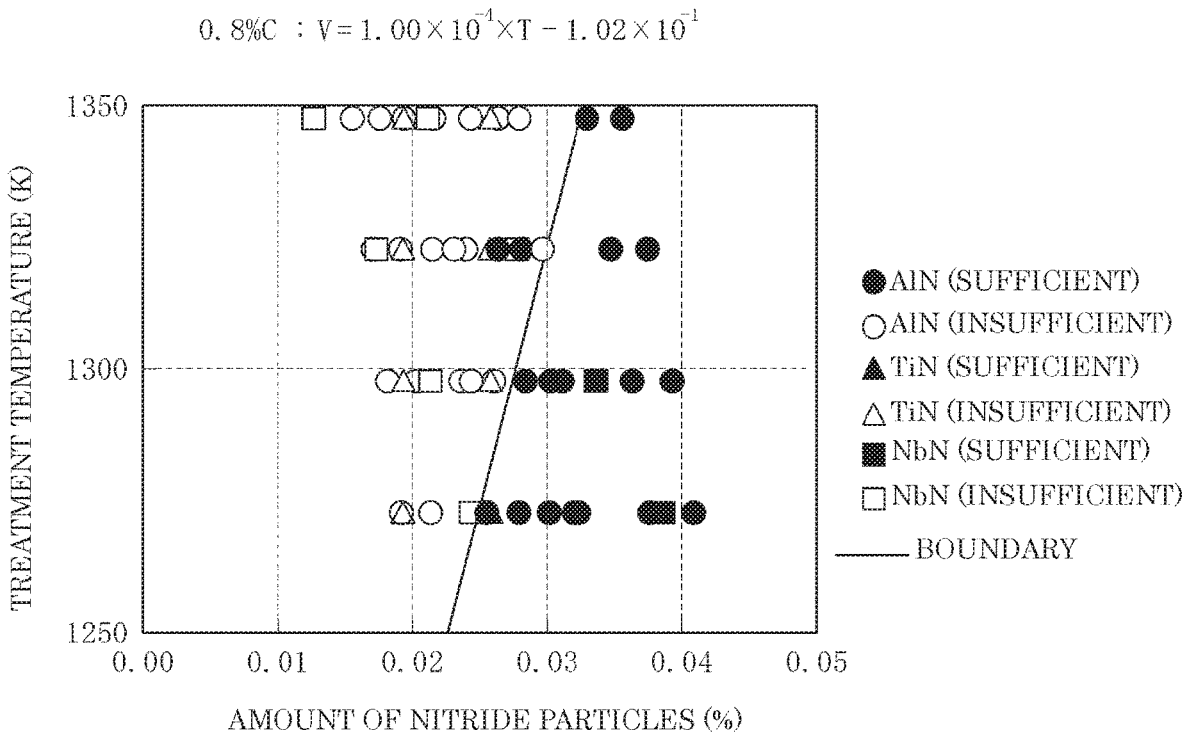
FIG. 4 is a diagram showing a relationship between the amount of nitride particles and a treatment temperature at 0.8% C.

In FIGS. 2, 3, and 4, the relationship between the minimum amount of nitride particles for preventing crystal grains from becoming coarse and a treatment temperature is obtained at 0.2% C (% by mass, the same hereinbelow), at 0.6% C, and at 0.8% C, respectively while the horizontal axis represents an amount of nitride particles (% by mass) and the vertical axis represents a treatment temperature (K).

In these figures, the straight line slanting upward to the right in the figures represents a boundary between a region in which crystal grains become coarse and a region in which crystal grains coarsening is prevented. From the results of FIGS. 2, 3, and 4, it is found that as the C concentration increases in the steel, the crystal grain coarsening temperature decreases.

Accordingly, as the C concentration increases, it is necessary to form and precipitate more amounts of nitride particles (pinning particles) for preventing crystal grain coarsening.

In FIGS. 2, 3, and 4, the straight line slanting upward to the right in the figures is represented by V=a×T+b while setting the amount of nitride particles as V.

Here, a represents the slope of the straight line and b represents an intercept.

That is, in each C concentration, the presence or absence of crystal grain coarsening can be adjusted by the equation V=a×T+b and the following equations are established at 0.2% C, at 0.6% C, and at 0.8% C.

$$V=8.00\times10^{-5}\times T-8.08\times10^{-2}(0.2\%\ C)$$

$$V=9.31\times10^{-5}\times T-9.53\times10^{-2}(0.6\%\ C)$$

$$V=1.00\times10^{-4}\times T-1.02\times10^{-1}(0.8\%\ C)$$

Figure 5:
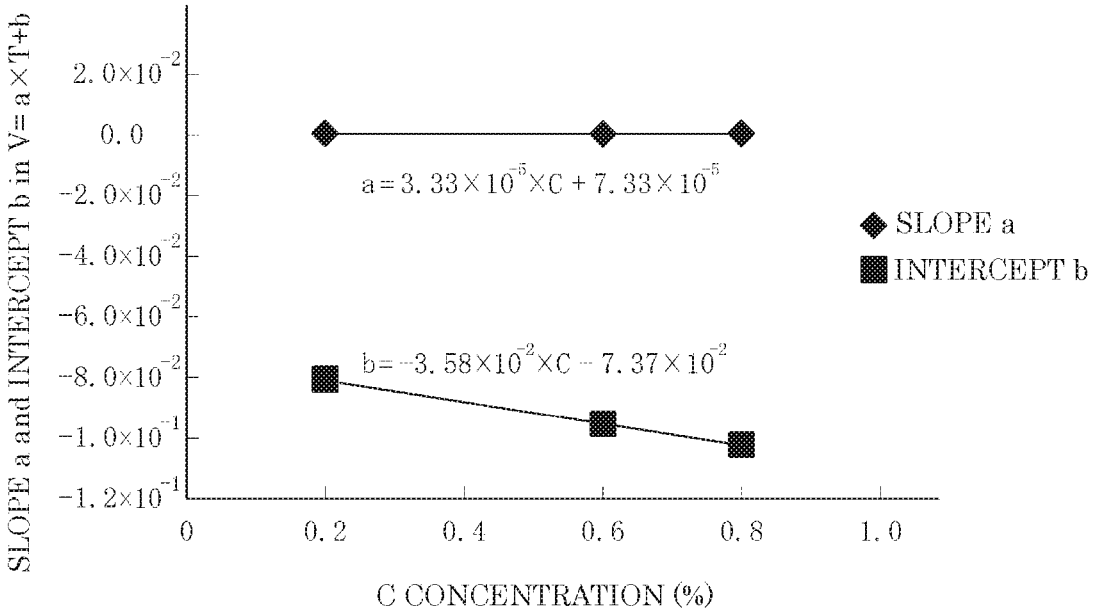
FIG. 5 is a diagram showing C concentration dependency of a slope a and an intercept b of Equation (1).

When C concentration dependency of a and b is obtained from the slops a and the intercepts b of each straight line at 0.2% C, at 0.6% C, and at 0.8% C, as shown in FIG. 5, the following equations are established.

$$a=3.33\times10^{-5}\times C+7.33\times10^{-5},\text{and}$$

$$b=-3.58\times10^{-2}\times C-7.37\times10^{-2}$$

That is, the minimum amount of nitride particles required to prevent crystal grain coarsening can be represented by the following Equation (1).

$$(3.33\times10^{-5}\times C+7.33\times10^{-5})\times T-(3.58\times10^{-2}\times C+7.37\times10^{-2}) \quad \text{Equation (1)}$$

Accordingly, when the amount V of nitride particles actually precipitated in the steel (the surface layer of the steel) satisfies the following equation:

$$V\geqq\text{Value of Equation (1)},$$

that is, when such a value of V is maintained during the carburizing treatment, crystal grain coarsening can be prevented and crystal grains can be retained to be fine.

Figure 6:
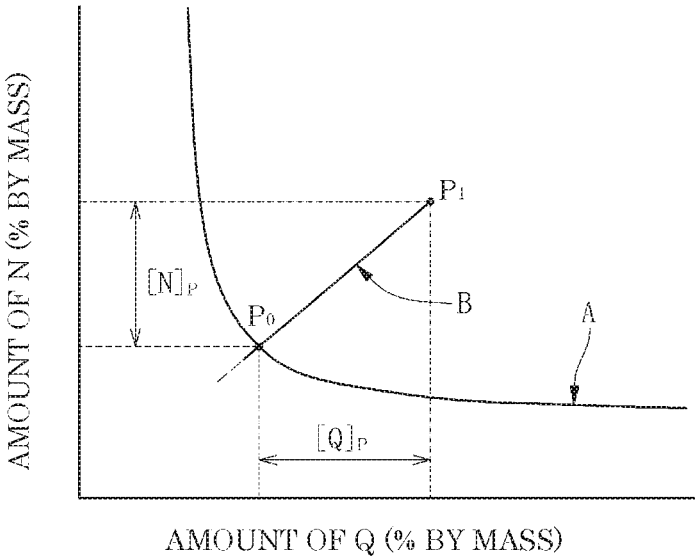
FIG. 6 is a diagram showing a relationship in the solubility product of the amount of precipitated N and the amount of precipitated Q.

In addition, the relationship between the amount of nitride particles precipitated due to combination of N with each of Al, Nb, and Ti, and the solubility product of each element and N are as shown in FIG. 6.

In the figure, A is a curve representing the solubility product, and B represents a relationship (ratio) between the amount of Q (% by mass) and the amount of N (% by mass) in a nitride of Q such as Al and N.

For example, when a nitride of Al and N is exemplified, an x-axis component of a line segment connecting intersections $P_0$ and $P_1$ of the curve A and the straight line B ($P_1$ is a coordinate value specified by ($x_1$, $y_1$) when the amount of Al contained in the steel is set to a value $x_1$ on the horizontal axis (x-axis) and the amount of N is set to a value $y_1$, on the vertical axis (y-axis)) is the amount of precipitated Al and a y-axis component thereof is the amount of precipitated N.

In addition, a region below the curve A is a region in which Al and N are solid-soluted.

[II] (Effect Confirmation Test)

Various types of steels having compositions shown in Table 2 were melted under vacuum at 950° C. to 1250° C., forged to φ30 mm, and normalized at 910° C. for 1 hour. Then, test pieces of φ25×100 mm and bending test pieces (4-point bending test pieces) 10 shown in FIG. 17 were prepared and subjected to a vacuum carburizing treatment.

Incidentally, test pieces for [I] were also prepared in the same manner.

In addition, as in the description regarding Table 1, even when P: ≤0.030%, S: ≤0.030%, Cu: ≤0.30%, and Ni: ≤0.25% are included in the steels in Table 2, these elements are impurities, and therefore not shown in the table.

In addition, O which is precipitated as an inclusion $Al_2O_3$ is not shown and regarding Al, the remaining Al is shown as "s-Al" as an amount effective for forming nitride particles as pinning particles.

Further, in r which is a Ti-added steel, Ti whose amount is equal to or less than the amount of N in terms of a molar ratio is crystallized as TiN and does not contribute to forming pinning particles. Thus, the remaining Ti is shown as excessive Ti in Table 2.

Incidentally, regarding r, the amount of Ti actually included in the initial steel including an amount of Ti to be crystallized as TiN is Ti: 0.042% and the amount of N is 0.008%.

Regarding s, SCM420 is the SCM420 that is defined by JIS G 4053 (2008).

TABLE 2

| Chemical composition (% by mass, remainder being Fe) | | | | | | | | | | | | |
|---|---|---|---|---|---|---|---|---|---|---|---|---|
| Symbol | | C | Si | Mn | Cr | Mo | Al | s-Al | Ti | Excessive Ti | Nb | N |
| o | SCr420 | 0.21 | 0.20 | 0.74 | 1.15 | 0.03 | 0.031 | 0.030 | — | — | — | 0.008 |
| p | SCr420 | 0.20 | 0.20 | 0.75 | 1.14 | 0.03 | 0.031 | 0.030 | — | — | — | 0.020 |
| q | SCr420 | 0.20 | 0.21 | 0.75 | 1.15 | 0.03 | 0.004 | 0.030 | — | — | 0.051 | 0.008 |
| r | SCr420 | 0.19 | 0.20 | 0.74 | 1.14 | 0.03 | 0.004 | 0.030 | 0.042 | 0.015 | — | 0.008 |
| s | SCM420 | 0.20 | 0.21 | 0.75 | 1.14 | 0.30 | 0.031 | 0.030 | — | — | — | 0.008 |

Here, the vacuum carburizing treatment was performed under the following conditions.

That is, the vacuum carburizing treatment was performed using a treatment furnace having a furnace volume of 400 L under a pressure of 1500 Pa reduced by vacuum drawing of the furnace with changing a treatment temperature within a range of 1273 K to 1323 K.

Figure 7:
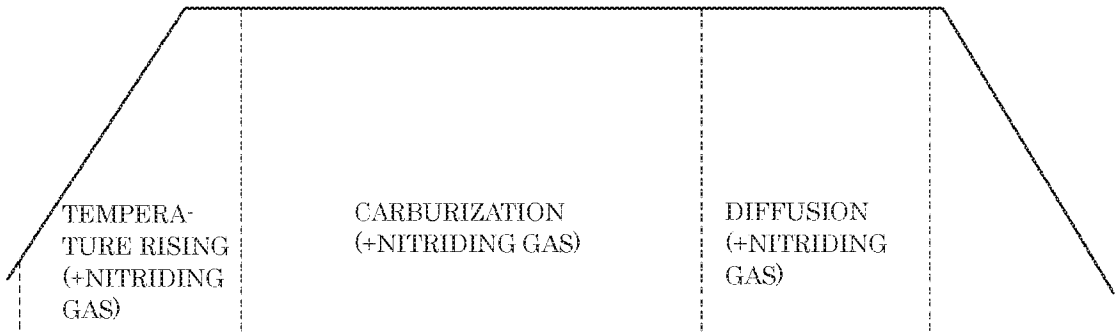
FIG. 7 is a diagram showing treatment conditions for a vacuum carburizing treatment in an embodiment.

Here, in Treatment A, Treatment D, and Treatment F, the carburizing conditions including the presence or absence of introduction of a carburizing gas are changed as shown in FIG. 7.

During these carburizing treatments, the amount of C and the amount of N in the surface layer of the test piece (part) and the inner portion of the test piece (the inner portion of the part) were determined respectively through combustion analysis by taking out the test pieces from the treatment furnace at various timings in the middle of the progress of the treatments, rapidly cooling the test pieces, and collecting cut scrapes at each depth of 0.05 mm (for surface layer analysis) and 3 mm (for inner portion analysis) from the surface of each test piece.

Here, the amount of C was determined according to JIS G 1211-3 (2011), and the amount of N was determined according to JIS G 1228 (2006). In addition, the contents of JIS G 1211-3 (2011) and JIS G 1228 (2006) are incorporated herein by reference.

These results are shown in Tables 3 and 4.

TABLE 3

| | | Treatment conditions | | | | | Surface layer | | Inner portion | |
|---|---|---|---|---|---|---|---|---|---|---|
| | | Time ks | Temperature ° C. | Temperature K | Carburization | $NH_3$ L/min | N concentration % by mass | Amount of nitride % by mass | N concentration % by mass | Amount of nitride % by mass |
| Treatment: | A | 0.00 | | | | | | | | |
| Material: | o | 3.30 | 850 | 1123 | | | 0.008 | 0.022 | 0.008 | 0.022 |
| Treatment temperature: | 1050° C. (1323 K) | 5.40 | 1050 | 1323 | | | 0.009 | 0.015 | 0.007 | 0.010 |
| Treatment contents: | Vacuum | 5.60 | 1050 | 1323 | ○ | | 0.008 | 0.012 | 0.008 | 0.012 |
| | (No. 1) | 5.73 | 1050 | 1323 | ○ | | 0.008 | 0.012 | 0.008 | 0.012 |
| | | 5.90 | 1050 | 1323 | | | 0.009 | 0.015 | 0.008 | 0.012 |
| | | 7.02 | 1050 | 1323 | | | 0.007 | 0.010 | 0.008 | 0.012 |
| Treatment: | D | 0.00 | | | | | | | | |
| Material: | o | 3.30 | 850 | 1123 | | 0.67 | 0.100 | 0.045 | 0.009 | 0.024 |
| Treatment temperature: | 1050° C. (1323 K) | 5.40 | 1050 | 1323 | | 0.67 | 0.044 | 0.041 | 0.008 | 0.012 |
| Treatment contents: | Nitrification | 5.60 | 1050 | 1323 | ○ | 0.67 | 0.041 | 0.041 | 0.008 | 0.012 |
| | | 5.73 | 1050 | 1323 | ○ | 0.67 | 0.032 | 0.039 | 0.008 | 0.012 |
| | (No. 2) | 5.90 | 1050 | 1323 | | 0.67 | 0.029 | 0.038 | 0.007 | 0.010 |
| | | 7.02 | 1050 | 1323 | | 0.67 | 0.026 | 0.036 | 0.008 | 0.012 |
| Treatment: | F | 0.00 | | | | | | | | |
| Material: | o | 3.30 | 850 | 1123 | | 0.15 | 0.045 | 0.045 | 0.008 | 0.022 |
| Treatment temperature: | 1000° C. (1273 K) | 5.40 | 1000 | 1273 | | 0.15 | 0.020 | 0.036 | 0.007 | 0.013 |
| Treatment contents: | Nitrification | 5.81 | 1000 | 1273 | ○ | 0.15 | 0.017 | 0.032 | 0.008 | 0.016 |
| | (No. 3) | 6.20 | 1000 | 1273 | ○ | 0.15 | 0.015 | 0.030 | 0.008 | 0.016 |
| | | 6.43 | 1000 | 1273 | | 0.15 | 0.015 | 0.030 | 0.007 | 0.013 |
| | | 8.10 | 1000 | 1273 | | 0.15 | 0.015 | 0.030 | 0.008 | 0.016 |
| Treatment: | A | 0.00 | | | | | | | | |
| Material: | o | 3.30 | 850 | 1123 | | | 0.020 | 0.043 | 0.019 | 0.042 |
| Treatment temperature: | 1050° C. (1323 K) | 5.40 | 1050 | 1323 | | | 0.017 | 0.028 | 0.020 | 0.032 |
| Treatment contents: | Vacuum | 5.60 | 1050 | 1323 | ○ | | 0.014 | 0.024 | 0.021 | 0.033 |
| | (No. 4) | 5.73 | 1050 | 1323 | ○ | | 0.012 | 0.021 | 0.020 | 0.032 |
| | | 5.90 | 1050 | 1323 | | | 0.012 | 0.021 | 0.021 | 0.033 |
| | | 7.02 | 1050 | 1323 | | | 0.013 | 0.022 | 0.020 | 0.032 |

TABLE 4

| | | Treatment conditions | | | | | Surface layer | | Inner portion | |
|---|---|---|---|---|---|---|---|---|---|---|
| | | Time ks | Temperature ° C. | Temperature K | Carburization | $NH_3$ L/min | N concentration % by mass | Amount of nitride % by mass | N concentration % by mass | Amount of nitride % by mass |
| Treatment: | D | 0.00 | | | | | | | | |
| Material: | p | 3.30 | 850 | 1123 | | 0.67 | 0.120 | 0.045 | 0.020 | 0.0427 |
| Treatment temperature: | 1050° C. (1323 K) | 5.40 | 1050 | 1323 | | 0.67 | 0.048 | 0.042 | 0.021 | 0.0329 |

TABLE 4-continued

| | | Treatment conditions | | | | | Surface layer | | Inner portion | |
|---|---|---|---|---|---|---|---|---|---|---|
| | | Time ks | Temperature ° C. | Temperature K | Carburization | $NH_3$ L/min | N concentration % by mass | Amount of nitride % by mass | N concentration % by mass | Amount of nitride % by mass |
| Treatment contents: | Nitrification | 5.60 | 1050 | 1323 | ○ | 0.67 | 0.042 | 0.041 | 0.020 | 0.0319 |
| | (No. 5) | 5.73 | 1050 | 1323 | ○ | 0.67 | 0.035 | 0.040 | 0.020 | 0.0319 |
| | | 5.90 | 1050 | 1323 | | 0.67 | 0.032 | 0.039 | 0.019 | 0.0309 |
| | | 7.02 | 1050 | 1323 | | 0.67 | 0.029 | 0.038 | 0.020 | 0.0319 |
| Treatment: | D | 0.00 | | | | | | | | |
| Material: | q | 3.30 | 850 | 1123 | | 0.67 | 0.076 | 0.103 | 0.008 | 0.0300 |
| Treatment temperature: | 1050° C. (1323 K) | 5.40 | 1050 | 1323 | | 0.67 | 0.031 | 0.072 | 0.008 | 0.0124 |
| Treatment contents: | Nitrification | 5.60 | 1050 | 1323 | ○ | 0.67 | 0.026 | 0.060 | 0.008 | 0.0124 |
| | (No. 6) | 5.73 | 1050 | 1323 | ○ | 0.67 | 0.023 | 0.054 | 0.008 | 0.0124 |
| | | 5.90 | 1050 | 1323 | | 0.67 | 0.017 | 0.037 | 0.008 | 0.0124 |
| | | 7.02 | 1050 | 1323 | | 0.67 | 0.016 | 0.031 | 0.008 | 0.0124 |
| Treatment: | D | 0.00 | | | | | | | | |
| Material: | r | 3.30 | 850 | 1123 | | 0.67 | 0.073 | 0.066 | 0.008 | 0.0288 |
| Treatment temperature: | 1050° C. (1323 K) | 5.40 | 1050 | 1323 | | 0.67 | 0.032 | 0.058 | 0.008 | 0.0218 |
| Treatment contents: | Nitrification | 5.60 | 1050 | 1323 | ○ | 0.67 | 0.027 | 0.055 | 0.008 | 0.0218 |
| | (No. 7) | 5.73 | 1050 | 1323 | ○ | 0.67 | 0.025 | 0.053 | 0.008 | 0.0218 |
| | | 5.90 | 1050 | 1323 | | 0.67 | 0.021 | 0.048 | 0.008 | 0.0218 |
| | | 7.02 | 1050 | 1323 | | 0.67 | 0.020 | 0.047 | 0.008 | 0.0218 |
| Treatment: | D | 0.00 | | | | | | | | |
| Material: | s | 3.30 | 850 | 1123 | | 0.67 | 0.100 | 0.045 | 0.008 | 0.0216 |
| Treatment temperature: | 1050° C. (1323 K) | 5.40 | 1050 | 1323 | | 0.67 | 0.044 | 0.041 | 0.008 | 0.0124 |
| Treatment contents: | Nitrification | 5.60 | 1050 | 1323 | ○ | 0.67 | 0.041 | 0.041 | 0.008 | 0.0124 |
| | (No. 8) | 5.73 | 1050 | 1323 | ○ | 0.67 | 0.032 | 0.039 | 0.008 | 0.0124 |
| | | 5.90 | 1050 | 1323 | | 0.67 | 0.029 | 0.038 | 0.008 | 0.0124 |
| | | 7.02 | 1050 | 1323 | | 0.67 | 0.026 | 0.036 | 0.008 | 0.0124 |

The mark "O" in the column of "Carburization" in Tables 3 and 4 indicates that a carburizing treatment had been performed.

Figure 8:
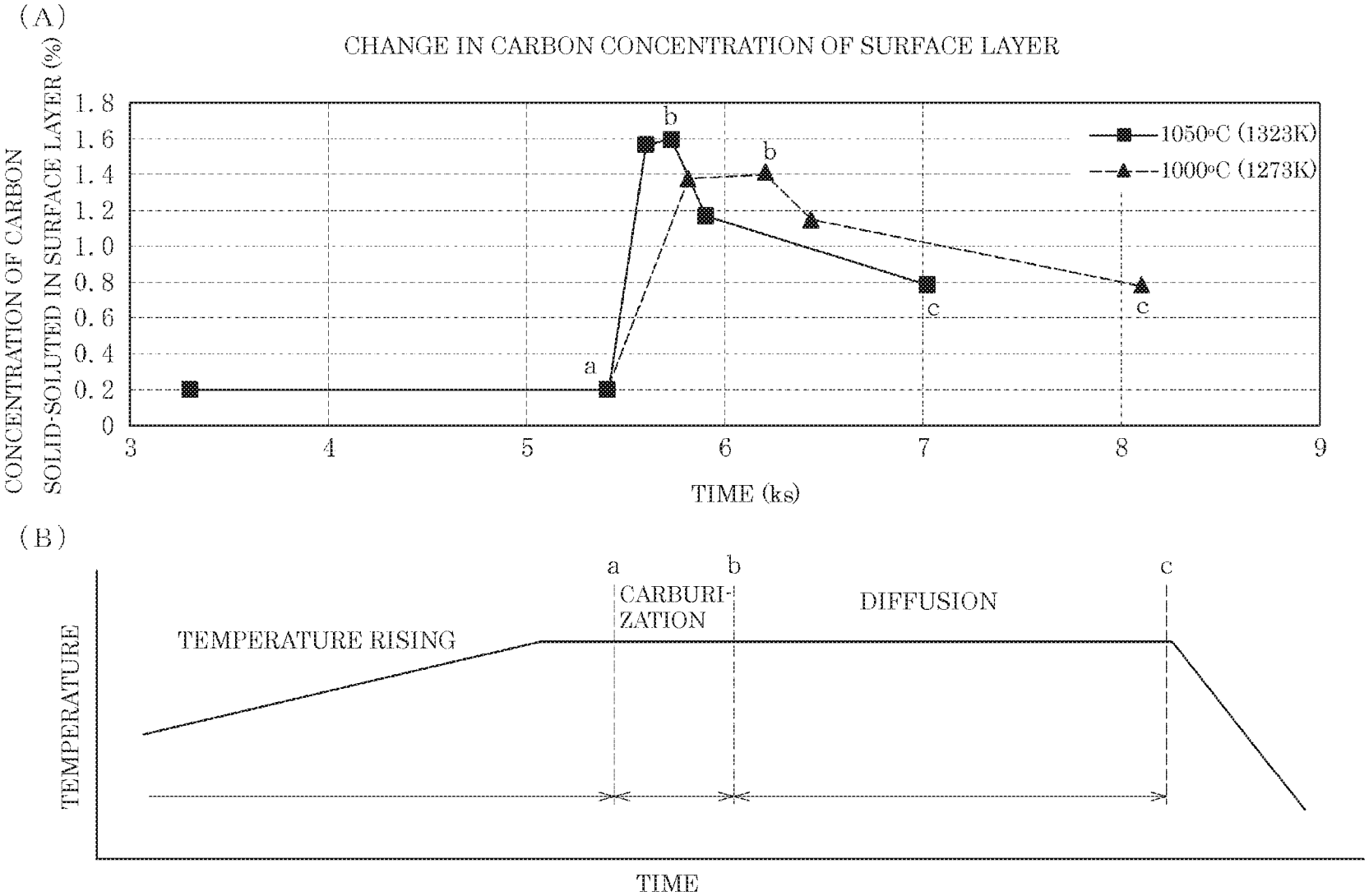
FIG. 8 are diagrams showing changes in the C concentration of a surface layer when a carburizing treatment is performed under the treatment conditions of FIG. 7.
Figure 9:
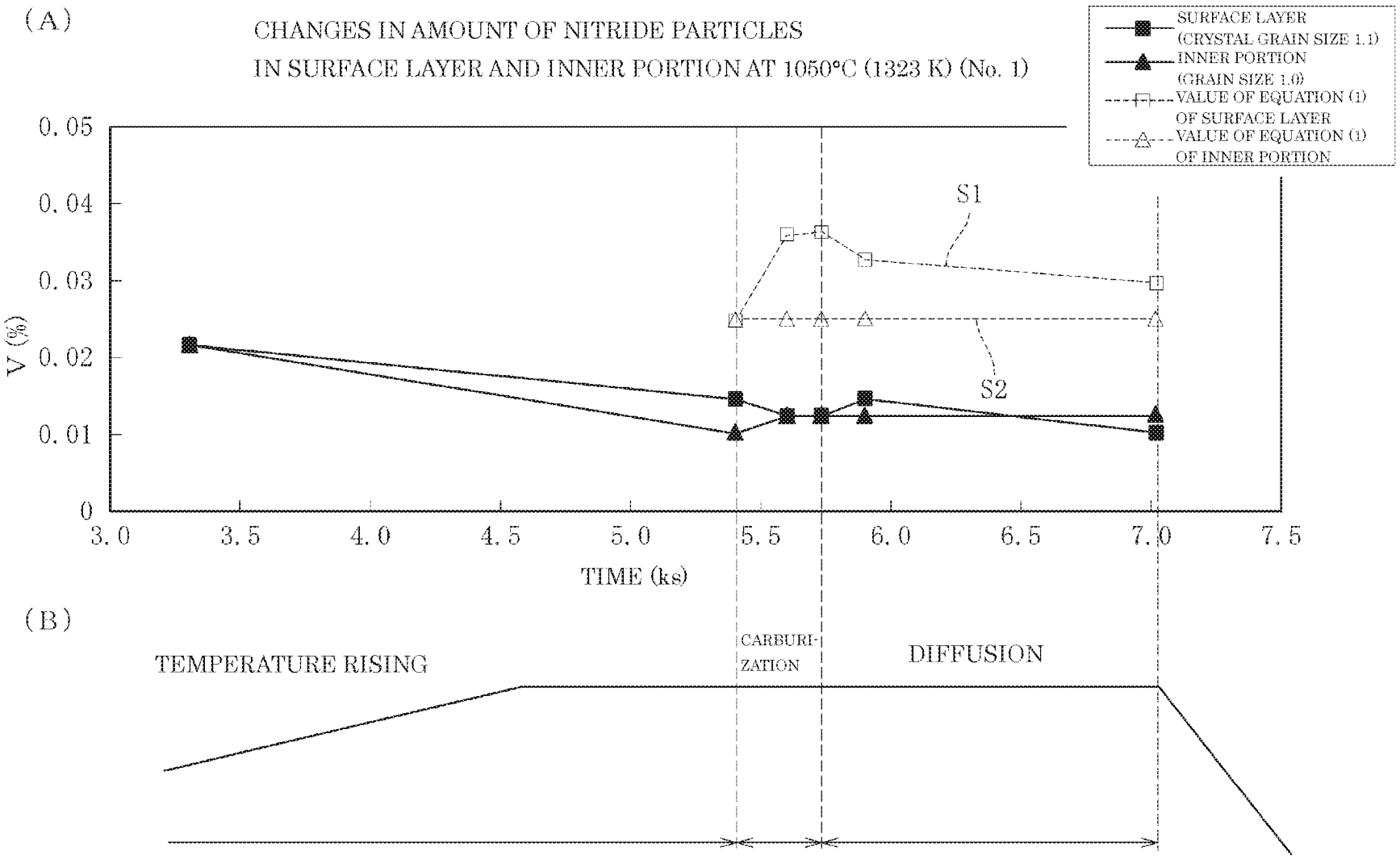
FIG. 9 is a graph showing changes in the amount of nitride particles in the surface layer and the inner portion of No. 1 in Table 3.
Figure 10:
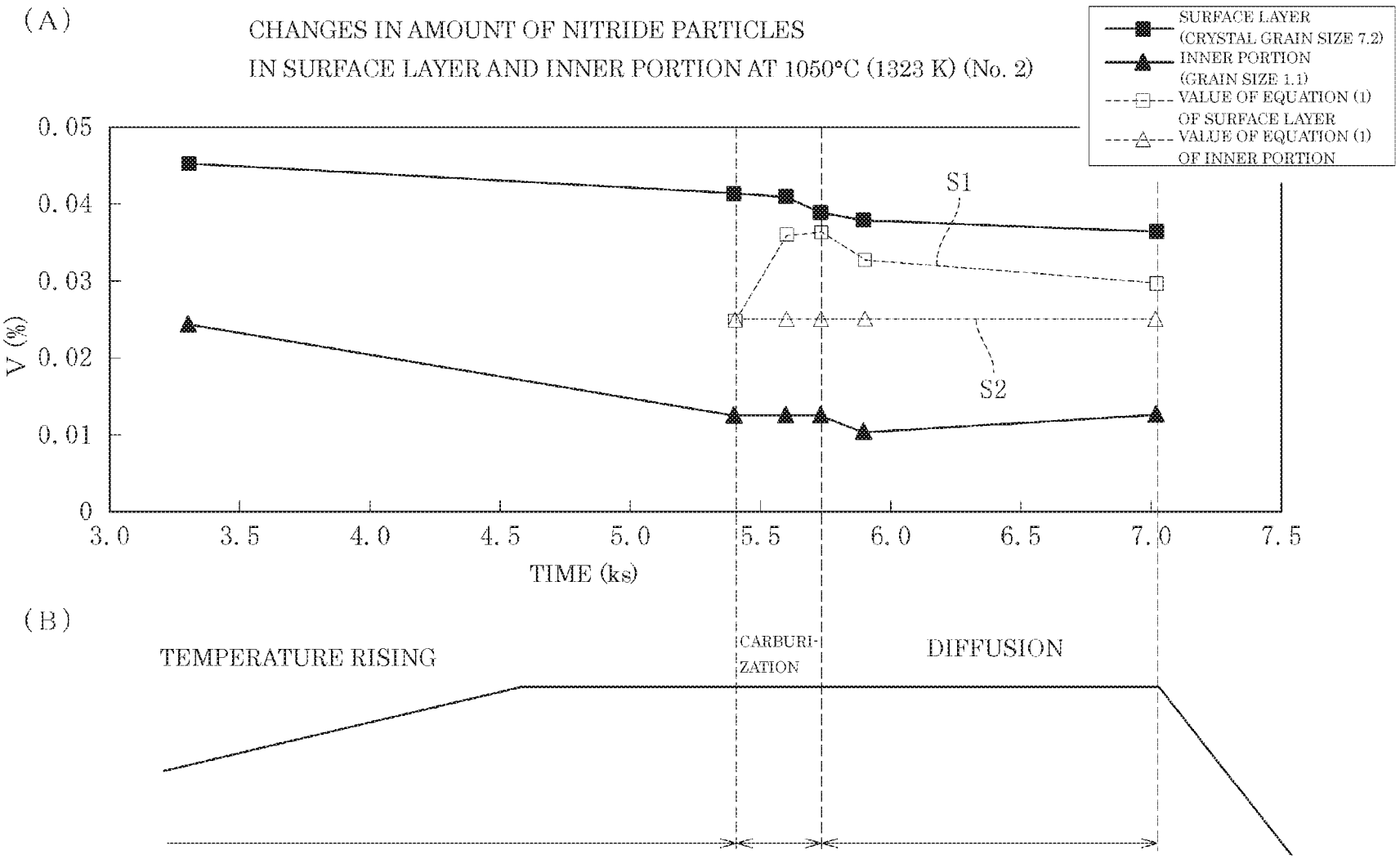
FIG. 10 is a graph showing changes in the amount of nitride particles in the surface layer and the inner portion of No. 2 in Table 3.
Figure 11:
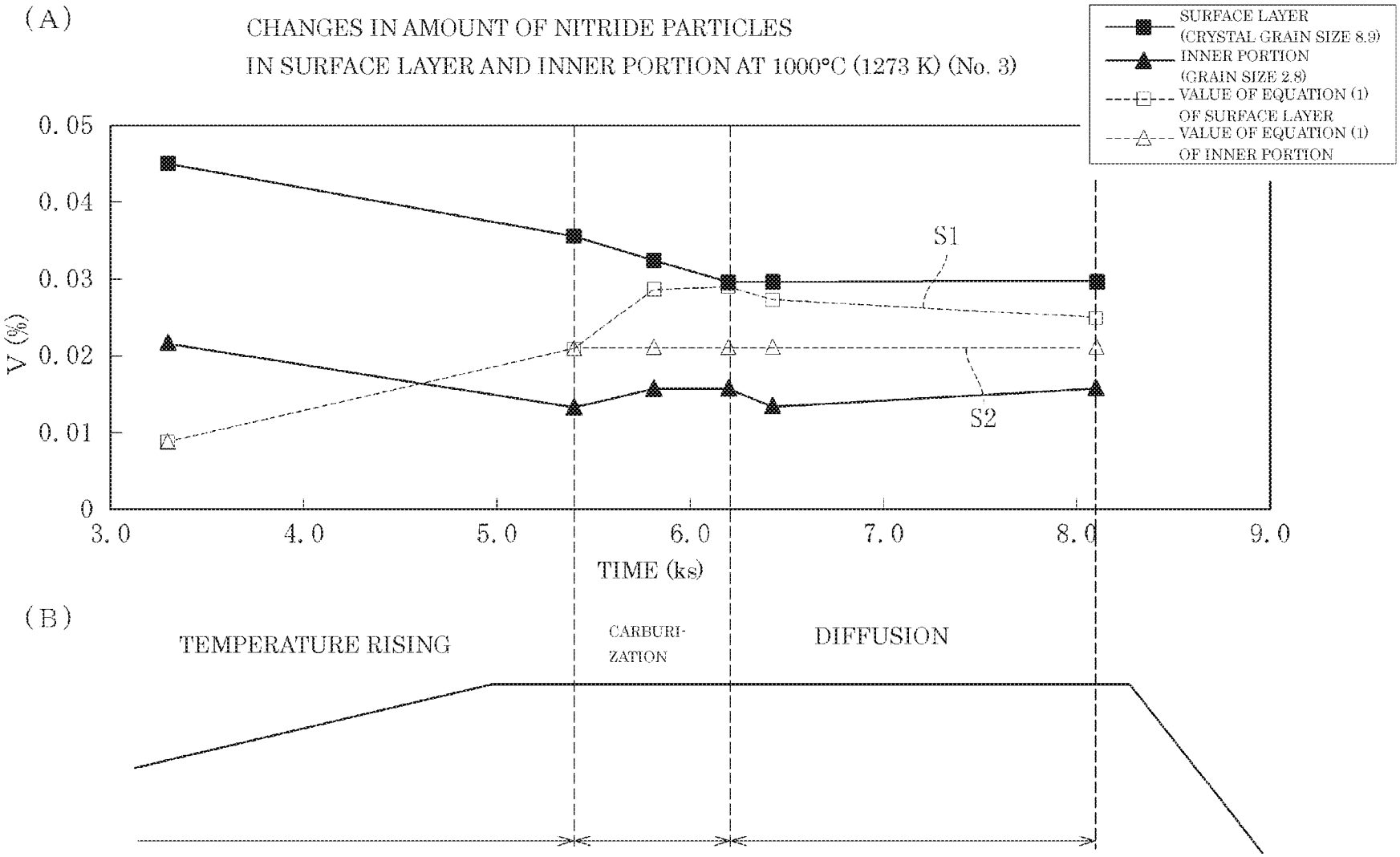
FIG. 11 is graph showing changes in the amount of nitride particles in the surface layer and the inner portion of No. 3 in Table 3.

In addition, based on the results of Tables 3 and 4, changes in the C concentration of the surface layer are shown in FIG. 8, changes in the amount of nitride particles in the surface layer and the inner portion of No. 1 at a treatment temperature of 1323 K (1050° C.) are shown in FIG. 9, changes in the amount of nitride particles in the surface layer and the inner portion of No. 2 at a treatment temperature of 1323 K (1050° C.) are shown in FIG. 10, and changes in the amount of nitride particles in the surface layer and the inner portion of No. 3 at a treatment temperature of 1273 K (1000° C.) are shown in FIG. 11.

Figure 12:
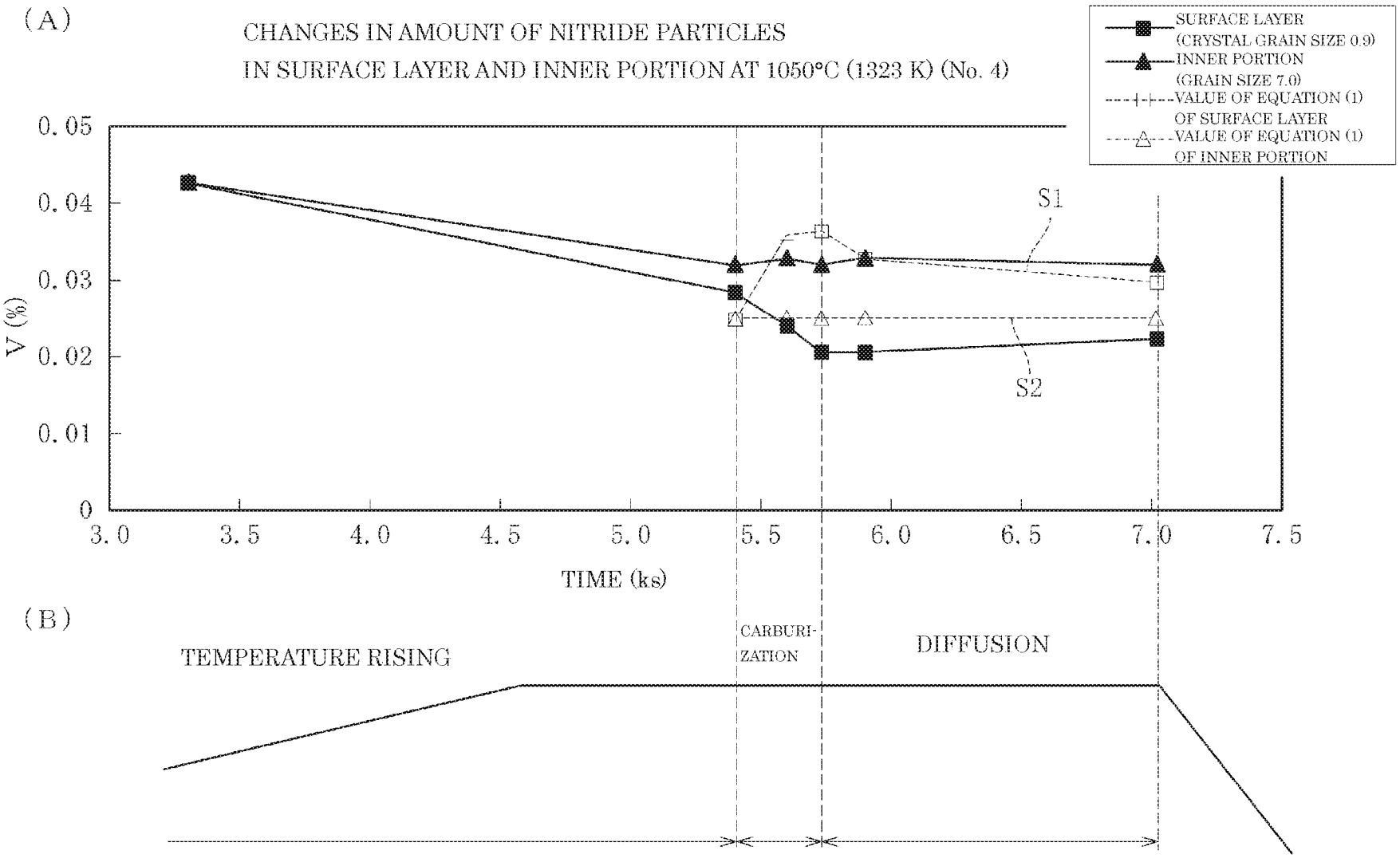
FIG. 12 is a graph showing changes in the amount of nitride particles in the surface layer and the inner portion of No. 4 in Table 3.
Figure 13:
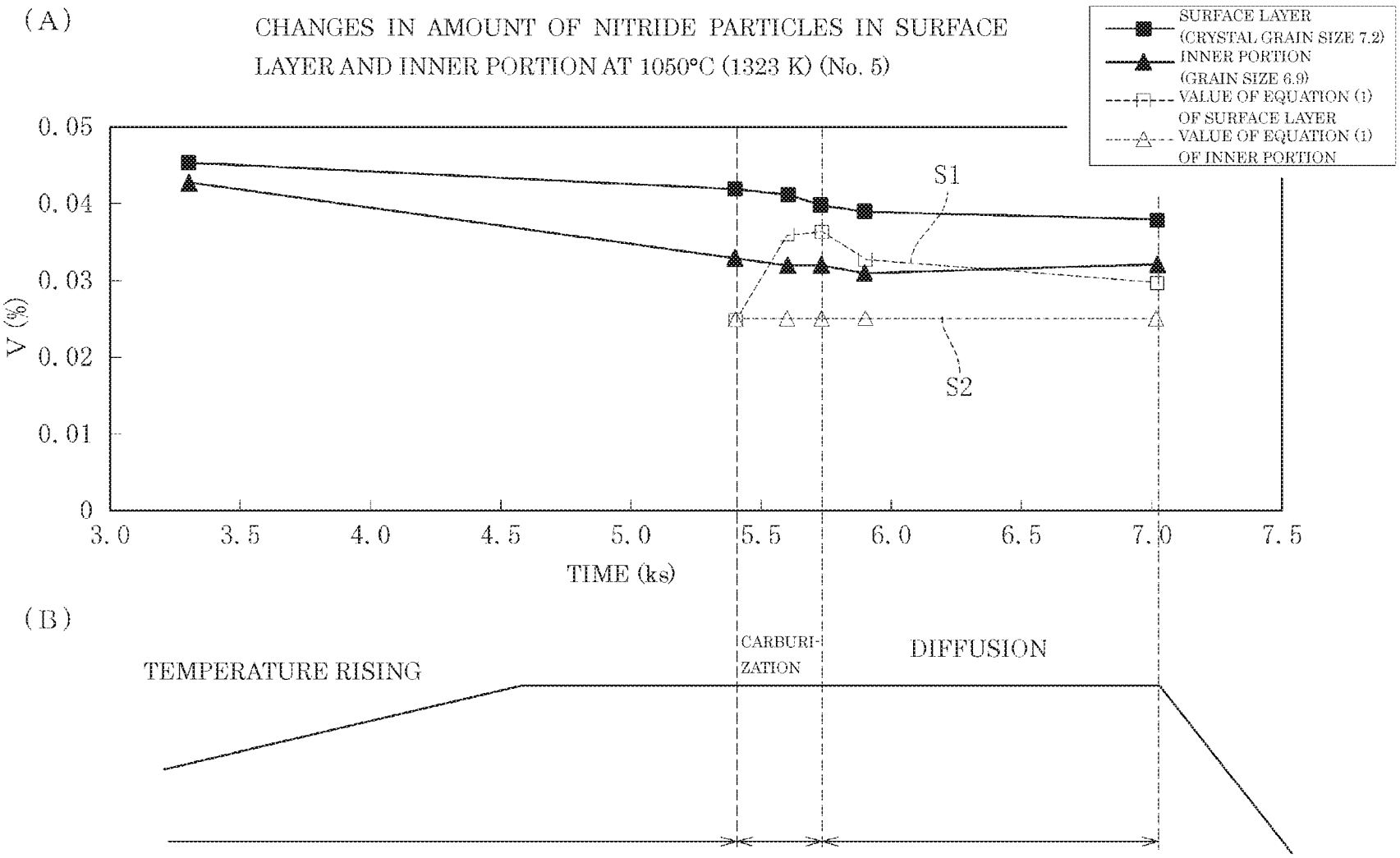
FIG. 13 is a graph showing changes in the amount of nitride particles in the surface layer and the inner portion of No. 5 in Table 3.
Figure 14:
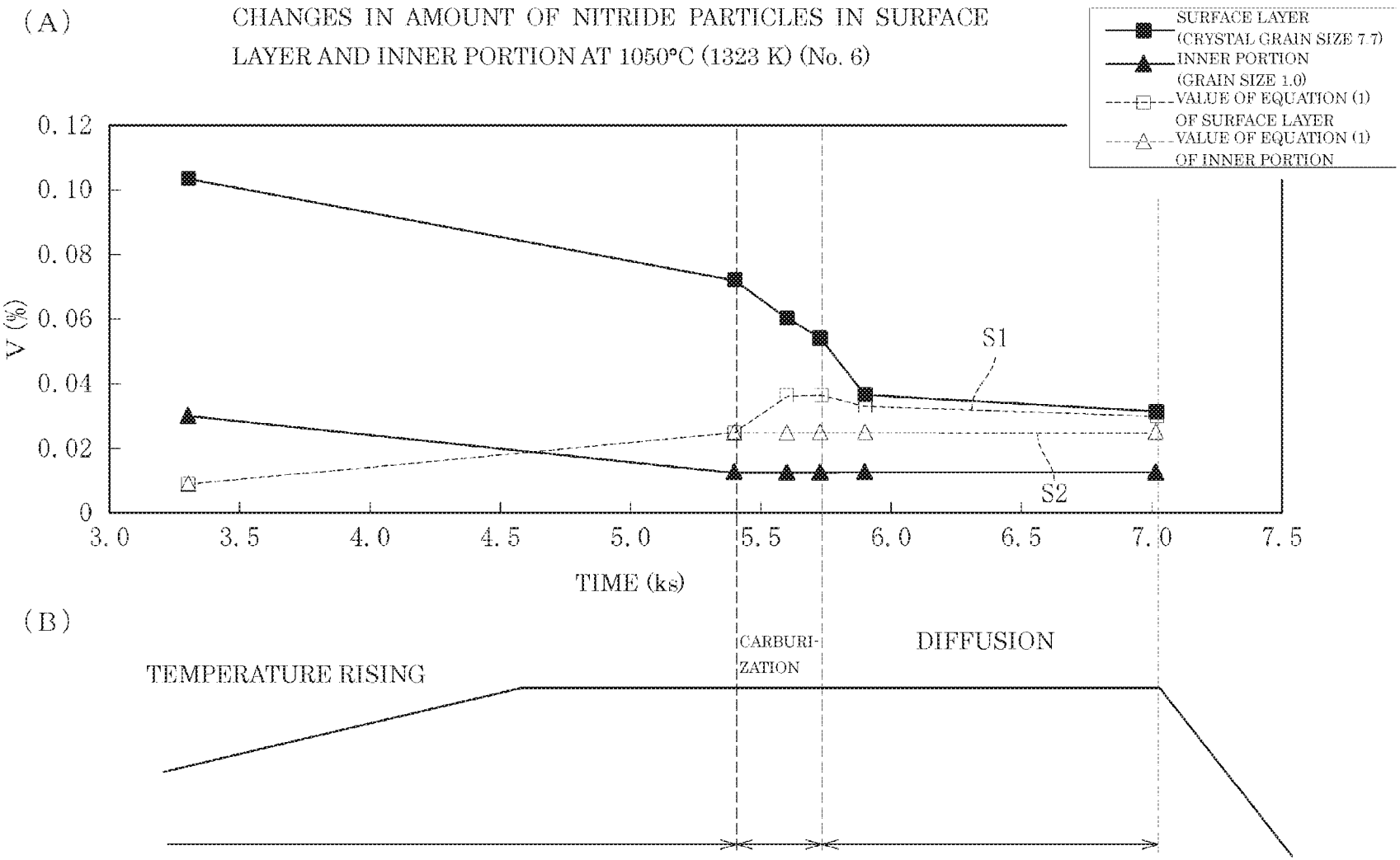
FIG. 14 is a graph showing changes in the amount of nitride particles in the surface layer and the inner portion of No. 6 in Table 3.
Figure 15:
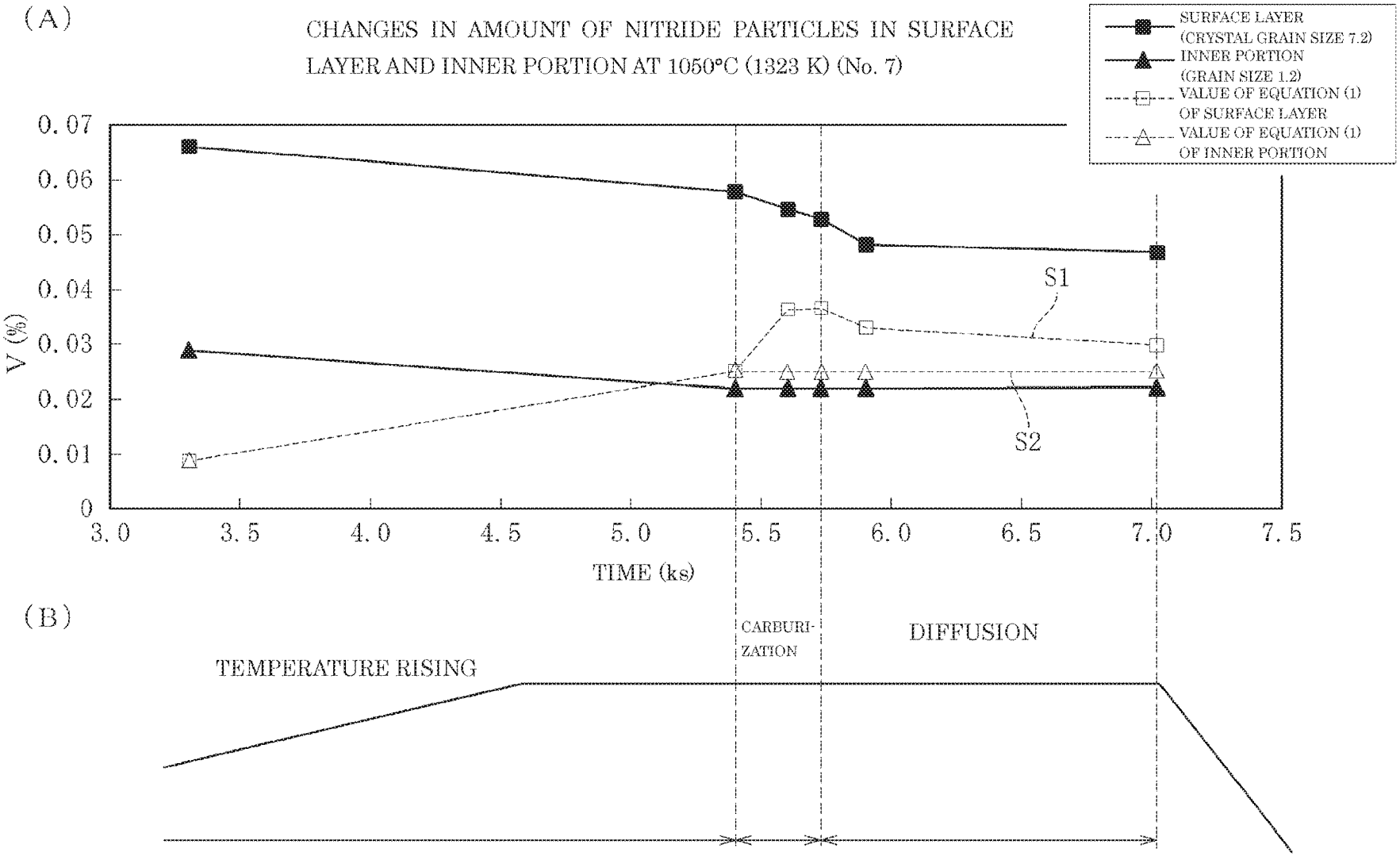
FIG. 15 is a graph showing changes in the amount of nitride particles in the surface layer and the inner portion of No. 7 in Table 3.
Figure 16:
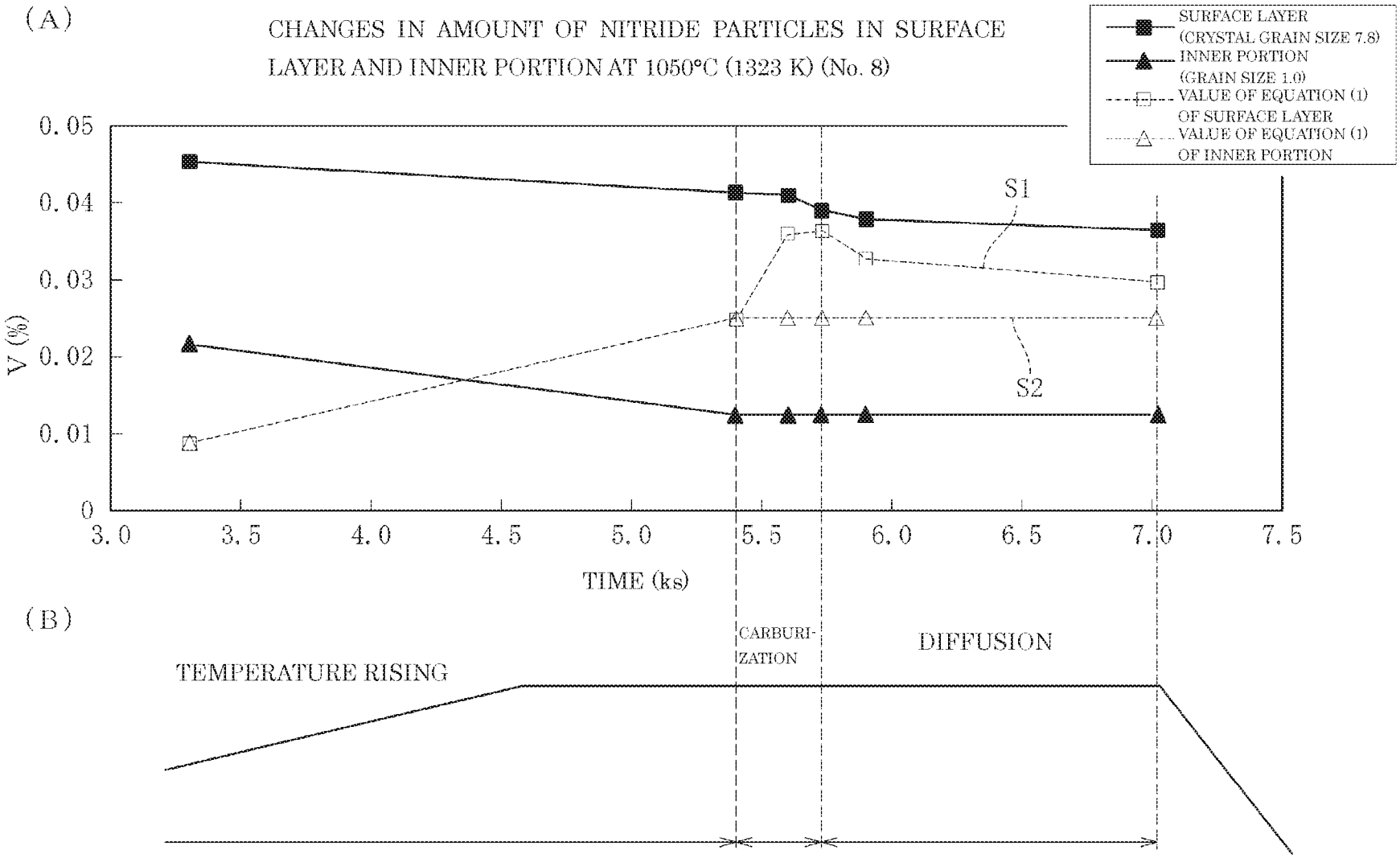
FIG. 16 is a graph showing changes in the amount of nitride particles in the surface layer and the inner portion of No. 8 in Table 3.
Figure 17A:
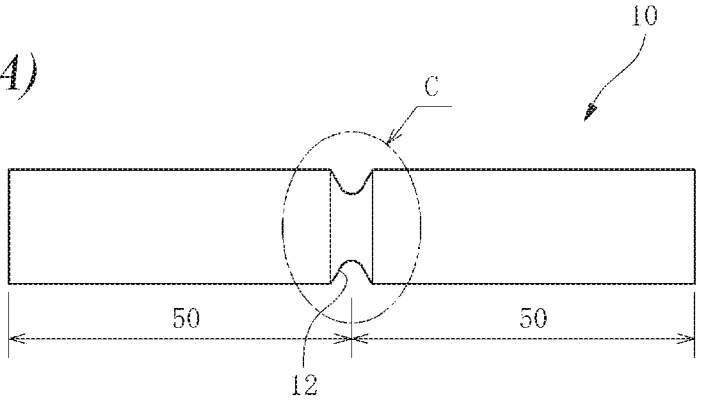
FIGS. 17(A)-17(C) are diagrams showing the shape of a test piece for a 4-point bending fatigue test.
Figure 17C:
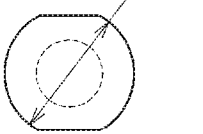
Figure 17C:
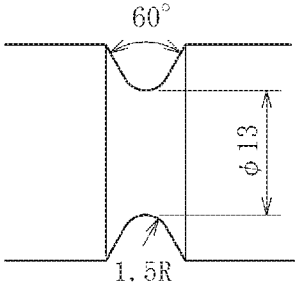
Figure 17B:
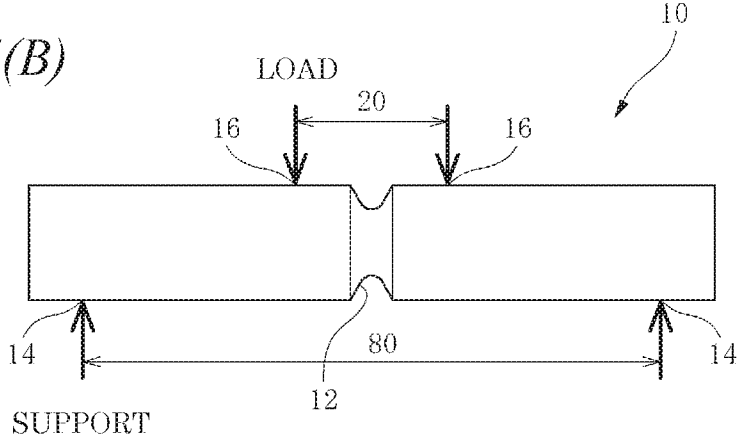

Further, changes in the amount of nitride particles in the surface layer and the inner portion of No. 4 at a treatment temperature of 1323 K (1050° C.) are shown in FIG. 12, changes in the amount of nitride particles in the surface layer and the inner portion of No. 5 at a treatment temperature of 1323 K (1050° C.) are shown in FIG. 13, changes in the amount of nitride particles in the surface layer and the inner portion of No. 6 at a treatment temperature of 1323 K (1050° C.) are shown in FIG. 14, changes in the amount of nitride particles in the surface layer and the inner portion of No. 7 at a treatment temperature of 1323 K (1050° C.) are shown in FIG. 15, and changes in the amount of nitride particles in the surface layer and the inner portion of No. 8 at a treatment temperature of 1323 K (1050° C.) are shown in FIG. 16, respectively.

As shown in FIG. 8, the C concentration of the surface layer of the steel is rapidly increased by applying $C_3H_8$ as a carburizing gas during the carburization period.

In addition, in the case where the treatment temperature is low, the carburization period is set to be long.

As described above, the C concentration of the surface layer of the steel changes along with the progress of the carburizing treatment. Accordingly, the amount of nitride particles for preventing crystal grain coarsening also changes during the carburizing treatment according to the change of the C concentration.

The curve S1 in FIGS. 9 to 16 shows a change in the value of the Equation (1) of the surface layer along with the progress of the carburizing treatment, and the curve S2 shows a change in the value of the Equation (1) of the inner portion, respectively.

The curve S1 is a curve showing a boundary of whether crystal grain coarsening occurs or the crystal grain coarsening is prevented in the surface layer, that is, a threshold value, and the curve S2 is a curve showing a threshold value of a boundary of whether crystal grain coarsening occurs or the crystal grain coarsening is prevented in the inner portion.

As shown in these figures, in all treatment examples in which the amount of nitride particles in the surface layer is above the curve S1 represented by the Equation (1) throughout the entire period of the carburizing treatment, the crystal grain size of the surface layer after the carburizing treatment can be maintained at a crystal grain size number of greater than 5 as shown in the column of the average crystal grain size in Table 5.

In contrast, in all treatment examples in which the amount of nitride particles in the inner portion is below the curve S2 represented by the Equation (1) throughout the entire period of the carburizing treatment or temporarily, the crystal grain size of the inner portion after the carburizing treatment can be maintained at a crystal grain size number of 5 or less.

[III] (Fatigue Test)

Using the test piece 10 shown in FIG. 17 which had been subjected to the above-described carburizing treatment, a 4-point bending test was performed to evaluate fatigue properties.

The bending test piece 10 has a neck portion 12 at a center portion in an axial direction as shown in FIG. 17.

Here, the test piece 10 was bent and deformed by applying load from input portions 16 at 2 points to the bending test piece 10 downward in a state that the test piece 10 were supported on support portions 14 at 2 points from the lower side, the load was then removed, and the form of the test piece was returned to the original state. Then, load was applied again and this process was repeatedly performed. Here, bending fatigue properties were evaluated by performing a pulsating fatigue test at the minimum stress/maximum stress ratio of 0.1 to obtain the maximum load at which fatigue fracture occurred when the number of repeated bending times reached $10^2$ and $10^6$, respectively. The results are collectively shown in Table 5.

TABLE 5

| No. | Treatment symbol | Steel type symbol | Carburization temperature ° C. | Presence or absence of nitriding gas | Average crystal grain size: Surface layer | | Average crystal grain size: Inner portion | | Bending fatigue strength kN: $10^2$ times | Bending fatigue strength kN: $10^6$ times |
|---|---|---|---|---|---|---|---|---|---|---|
| 1 | A | o | 1050 | X | 1.1 | X | 1.0 | ○ | 29 | 8 |
| 2 | D | o | 1050 | ○ | 7.2 | ○ | 1.1 | ○ | 28 | 11 |
| 3 | F | o | 1000 | ○ | 8.9 | ○ | 2.8 | ○ | 28 | 12 |
| 4 | A | p | 1050 | X | 0.9 | X | 7.0 | X | 24 | 9 |
| 5 | D | p | 1050 | ○ | 7.2 | ○ | 6.9 | X | 23 | 12 |
| 6 | D | q | 1050 | ○ | 7.7 | ○ | 1.0 | ○ | 29 | 12 |
| 7 | D | r | 1050 | ○ | 7.2 | ○ | 1.2 | ○ | 29 | 12 |
| 8 | D | s | 1050 | ○ | 7.8 | ○ | 1.0 | ○ | 29 | 11 |

The mark "O" in the column of "Presence or absence of nitriding gas" in Table 5 indicates that there is a nitriding gas and the mark "X" therein indicates that there is no nitriding gas.

The mark "O" in the column of "Surface layer" of "Average crystal grain size" indicates that the crystal grain size number is greater than 5 and the mark "X" therein indicates that the crystal grain size number is 5 or less. The mark "O" in the column of "Inner portion" of "Average crystal grain size" indicates that the crystal grain size number is 5 or less, and the mark "X" therein indicates that the crystal grain size number is greater than 5.

Figure 19:
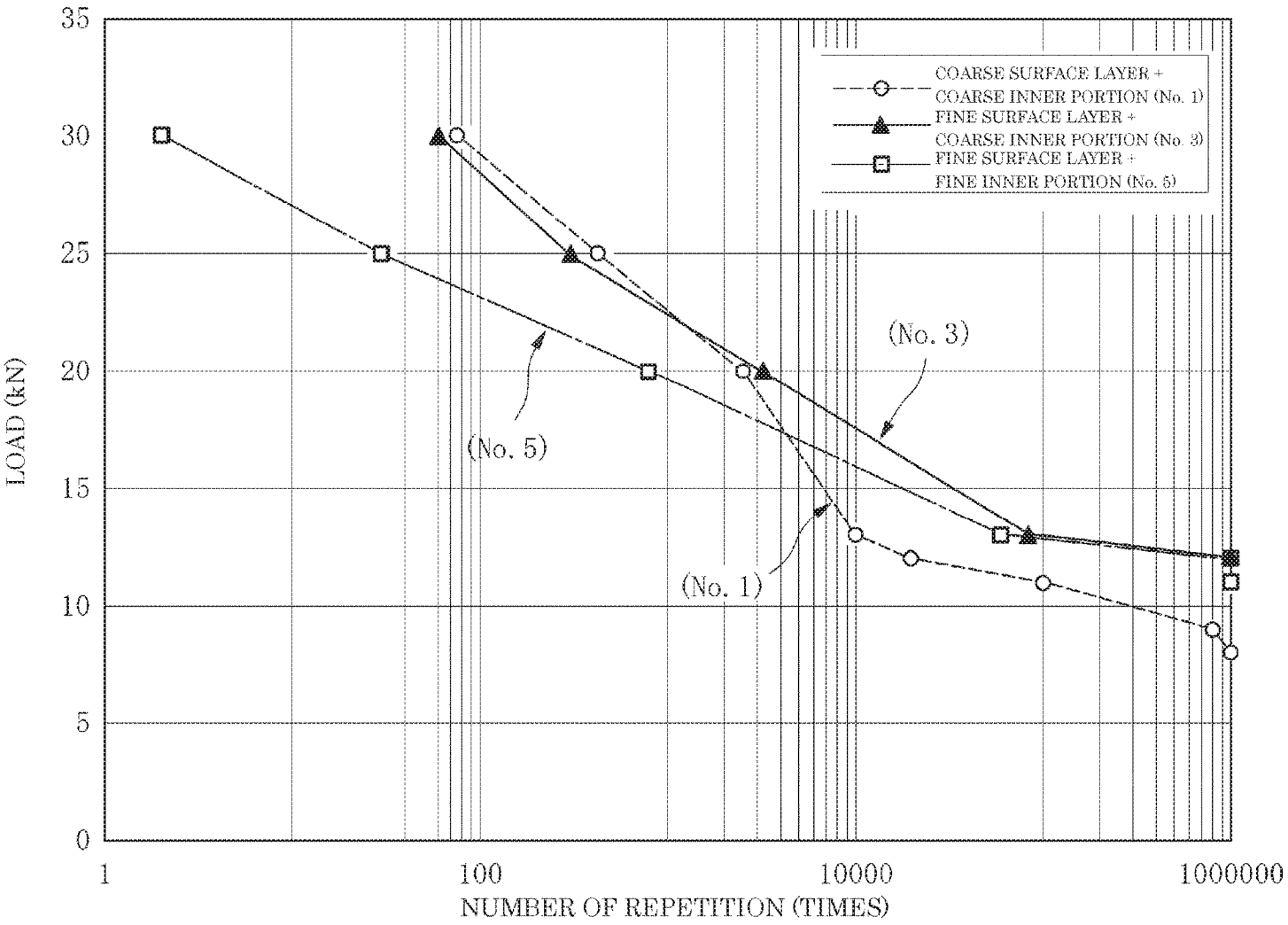
FIG. 19 is a diagram showing a relationship between a crystal grain size combination in the surface layer and the inner portion and fatigue properties.

FIG. 19 shows the results when a fatigue test according to the 4-point bending fatigue test of FIG. 17 by changing the input load is performed on a sample having coarse crystal grains in both of the surface layer and the inner portion (No. 1 in Table 5), a sample having fine crystal grains in the surface layer and coarse crystal grains in the inner portion (No. 3), and a sample (No. 5) having fine crystal grains in both of the surface layer and the inner portion.

In addition, in the sample No. 1, the crystal grain size number of the surface layer is 1.1 and the crystal grain size number of the inner portion is 1.0.

In addition, in the sample No. 3, the crystal grain size number of the surface layer is 8.9 and the crystal grain size number of the inner portion is 2.8. Further, in the sample No. 5, the crystal grain size number of the surface layer is 7.2 and the crystal grain size number of the inner portion is 6.9.

From the results shown in FIG. 19, the followings are found. In the sample (No. 5) having fine crystal grains in both of the surface layer and the inner portion, while the fatigue properties against a low load input is satisfactory, the fatigue properties against a high load input is not sufficient. Meanwhile, in the sample No. 1 having coarse crystal grains in both of the surface layer and the inner portion, while the fatigue properties against a high load input is satisfactory, the fatigue properties against a low load input is not sufficient. In contrast, in the sample No. 3 having fine crystal grains in the surface layer and coarse crystal grains in the inner portion, the fatigue properties against both of a low load input and a high load input are satisfactory, that is, the sample No. 3 has advantages of each of the sample No. 1 and the sample No. 5.

Figure 18A:
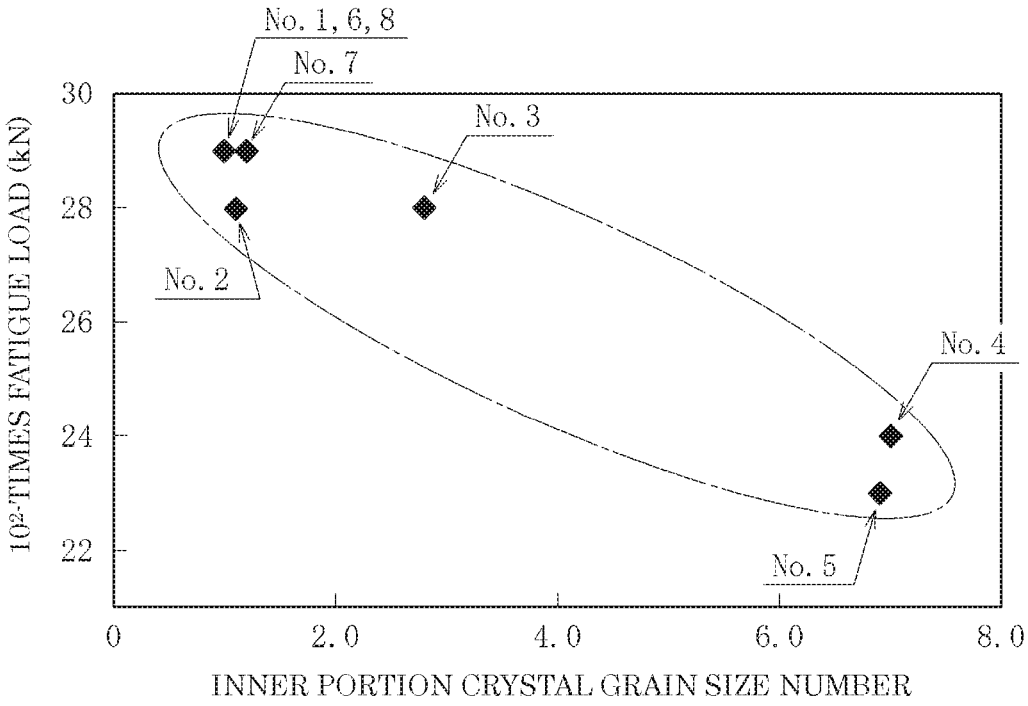
FIG. 18(A) is a diagram showing a relationship between the $10^2$-times fatigue load and the inner portion crystal grain size number.
Figure 18B:
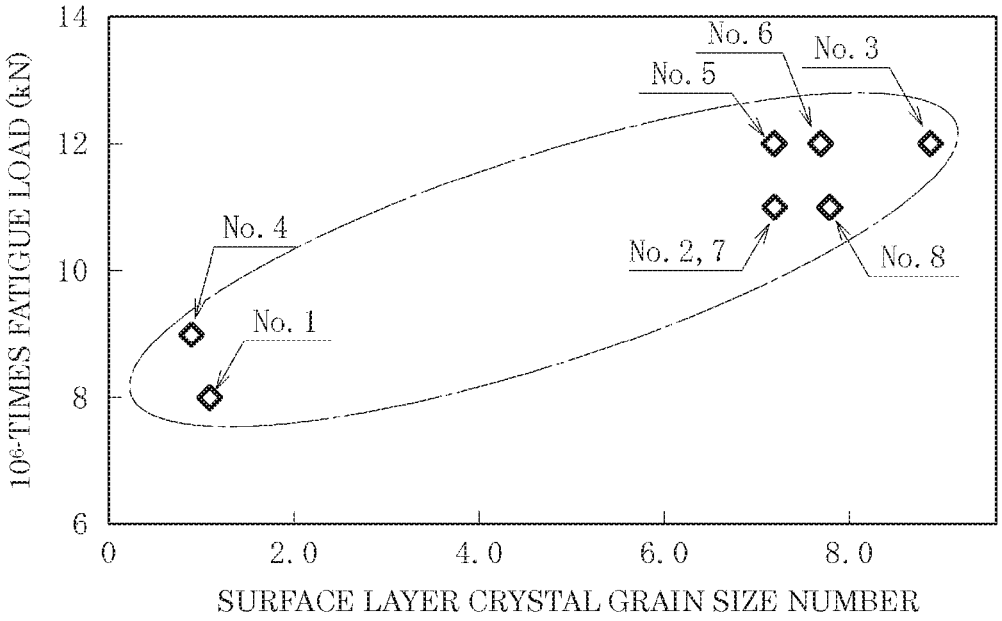
FIG. 18(B) is a diagram showing a relationship between the $10^6$-times fatigue load and the surface layer crystal grain size number.

FIG. 18 are diagrams showing results of a fatigue test of No. 1 to No. 8 in Table 5. FIG. 18(A) shows results of a fatigue test when a high load input is applied and FIG. 18(B) shows results of a fatigue test when a low load input is applied, receptively.

As shown in FIG. 18(B), the crystal grain size number of the surface layer is clearly correlated with fatigue properties under such a low load input that fracture occurs when the number of repeated bending time reaches $10^6$, and as the crystal grain size number of the surface layer increases, particularly, when the crystal grain size number is greater than 5, the fatigue properties are definitely satisfactory.

On the other hand, as shown in FIG. 18(A), the crystal grain size number of the inner portion is clearly correlated with fatigue properties even under such a high load input that fracture occurs when the number of repetitive bending time reaches $10^2$, that is, fracture occurs in an early stage. However, in this case, as the crystal grain size number of the inner portion decreases and the crystal grains become coarser, particularly, when the crystal grain size number is 5 or less, the fatigue properties are satisfactory.

Although the embodiments of the present invention have been described above, the embodiments are merely examples and embodiments to which various changes are applied within a range not departing from the gist of the present invention can be realized.

INDUSTRIAL APPLICABILITY

According to the present invention, it is possible to provide a carburized part having excellent fatigue properties against any of a low load input and a high load input, and a method for manufacturing the same.

While the present invention has been described in detail and with reference to specific embodiments thereof, it will be apparent to those skilled in the art that various changes and modifications can be made within a range not departing from the spirit and scope of the present invention.

Incidentally, this application is based on Japanese patent application No. 2013-119234 filed on Jun. 5, 2013, and the entire contents thereof being hereby incorporated by reference.

The invention claimed is:

1. A carburized part which is formed by processing a steel into a shape of a part and performing a carburizing treatment on the steel, the steel having a composition consisting essentially of, in terms of % by mass:

0.10% to 0.40% of C;
0.05% to 2.00% of Si;
0.30% to 2.00% of Mn;
0.30% to 3.00% of Cr;
0.025% or less of N;
0 to 0.80% of Mo, and
as a pinning particle forming element which forms a pinning particle by nitrification, one or two or more elements selected from:
0.020% to 0.100% of Al;
0.01% to 0.20% of Nb; and
0.005% to 0.20% of Ti,
with the remainder being Fe and inevitable impurities,
wherein a crystal grain size number of a surface layer of the part at a depth of 50 μm or less from a surface is greater than 5, and the crystal grain size number of an inner portion of the part at a depth of 3 mm or more from the surface is 5 or less,
wherein an N concentration in the surface layer of the part is higher than the N concentration in the inner portion of the part, and
wherein nitrides of one or two or more elements selected from Al, Nb, or Ti are precipitated in the surface layer of the part at a depth of 50 μm or less from the surface.

2. A method for manufacturing the carburized part according to claim 1, the method comprising:

processing a steel into a shape of a part, the steel having a composition consisting essentially of, in terms of % by mass:
0.10% to 0.40% of C;
0.05% to 2.00% of Si;
0.30% to 2.00% of Mn;
0.30% to 3.00% of Cr;
0.025% or less of N;
0 to 0.80% of Mo, and
as a pinning particle forming element which forms a pinning particle by nitrification, one or two or more elements selected from:
0.020% to 0.100% of Al;
0.01% to 0.20% of Nb; and
0.005% to 0.20% of Ti,
with the remainder being Fe and inevitable impurities;
then heating the steel in a treatment furnace at a temperature of $A_3$ point or higher and holding the steel to perform a vacuum carburizing treatment on the steel with a carburizing gas under reduced pressure;
controlling a nitriding atmosphere by introducing a nitriding gas into the treatment furnace during the vacuum carburizing treatment, such that a total amount V of nitride particles containing one or two or more of AlN which is a nitride of Al, NbN which is a nitride of Nb, and TiN which is a nitride of Ti in a surface layer at a depth of 50 μm or less from a surface of the part is maintained at a value represented by the following Equation (1) or more during the carburizing treatment; and
determining the content of N in the steel such that the total amount V of the nitride particles in an inner portion of the part at a depth of 3 mm or more from the surface is less than the value represented by the following Equation (1) during the carburizing treatment,
thereby obtaining a carburized part in which a crystal grain size number of the surface layer of the part is greater than 5 and the crystal grain size number of the inner portion of the part is 5 or less, $$(3.33\times10^{-5}\times C+7.33\times10^{-5})\times T-(3.58\times10^{-2}\times C+7.37\times10^{-2}) \quad \text{Equation (1)}$$

in the Equation (1), C represents a C concentration, and T represents a temperature, provided that the unit of V is % by mass, the unit of C is % by mass, and the unit of T is K.

* * * * *